US012145770B2

(12) United States Patent
Drummond et al.

(10) Patent No.: US 12,145,770 B2
(45) Date of Patent: Nov. 19, 2024

(54) BLANK FOR FORMING A SHIPPING CARTON WITH AN INTEGRATED DISPLAY TRAY

(71) Applicants: Packrite, LLC, High Point, NC (US); James L Einstein, Winston-Salem, NC (US)

(72) Inventors: Michael R. Drummond, High Point, NC (US); James L. Einstein, Winston Salem, NC (US); Sandra R. Perkins, High Point, NC (US)

( * ) Notice: Subject to any disclaimer, the term of this patent is extended or adjusted under 35 U.S.C. 154(b) by 0 days.

(21) Appl. No.: 18/085,872

(22) Filed: Dec. 21, 2022

(65) Prior Publication Data

US 2023/0125770 A1 Apr. 27, 2023

Related U.S. Application Data

(62) Division of application No. 17/246,991, filed on May 3, 2021, now Pat. No. 11,613,409.

(60) Provisional application No. 63/020,056, filed on May 5, 2020.

(51) Int. Cl.
*B65D 25/10* (2006.01)
*B65D 5/50* (2006.01)

(52) U.S. Cl.
CPC ..... *B65D 25/107* (2013.01); *B65D 5/5023* (2013.01)

(58) Field of Classification Search
CPC .. B65D 25/107; B65D 25/5023; B65D 25/00; B65D 25/04; B65D 25/06
USPC ..... 206/225, 226, 395, 408, 397, 588.4; 229/93, 181, 182, 165, 198, 190; 220/62; 225/48; 228/43, 49, 91
See application file for complete search history.

(56) References Cited

U.S. PATENT DOCUMENTS 363,143 A * 5/1887 Huston ..... B65D 5/28 229/190
997,109 A * 7/1911 Baird ..... B65D 5/3664 229/181
1,035,638 A * 8/1912 Reber ..... B65D 5/3664 229/189
1,174,417 A * 3/1916 Hill ..... B65D 5/22 229/199
1,177,410 A * 3/1916 Hatfield ..... B65D 5/28 229/920
1,207,421 A * 12/1916 Lord ..... B65D 5/2047 229/198.2
1,364,896 A * 1/1921 Bridgman ..... B65D 5/62 229/190
1,364,897 A * 1/1921 Harry ..... B65D 5/62 229/923

(Continued)

*Primary Examiner* — Steven A. Reynolds
*Assistant Examiner* — Prince Pal
(74) *Attorney, Agent, or Firm* — Jamison Law Firm, PLLC

(57) ABSTRACT

A foldable blank for forming a carton for shipping and displaying a plurality of products in an integrated tray is provided. The blank includes a rear panel, a first and second side panels both foldably connected to the rear panel, an exterior floor panel foldably connected to the rear panel, and a front panel foldably connected to the floor panel that is less than half the vertical height of the rear, first side, and second side panels and defines at least one retaining tab, wherein when the blank is folded to form the carton, each of the rear panel, first and second side panels, and front panel are at least partially double-walled.

3 Claims, 21 Drawing Sheets

(56) References Cited

U.S. PATENT DOCUMENTS 1,364,898 A * 1/1921 Harry ..... B65D 5/62 229/923
1,364,899 A * 1/1921 Bridgman ..... B65D 5/62 229/190
1,365,351 A * 1/1921 Harry ..... B65D 5/62 229/923
1,425,068 A * 8/1922 Sutherland ..... B65D 5/36 229/149
1,425,714 A * 8/1922 Stokes ..... B65D 5/6664 229/152
1,437,274 A * 11/1922 Harry ..... B65D 5/62 229/190
1,451,963 A * 4/1923 Scruby ..... B65D 5/2033 229/125.21
1,667,874 A * 5/1928 Harry ..... B65D 5/62 229/923
1,758,513 A * 5/1930 Gross ..... B65D 5/3664 229/172
1,811,135 A * 6/1931 Knowlton ..... B65D 5/28 229/190
1,821,960 A * 9/1931 Brooks, Jr. ..... B65D 5/5226 206/745
1,909,474 A * 5/1933 Keppler ..... B65D 5/524 229/152
2,041,274 A * 5/1936 Wood ..... B65D 5/22 229/175
2,106,816 A * 2/1938 Shimizu ..... B65D 5/2047 229/114
2,111,376 A * 3/1938 Van Wingen ..... B65D 5/28 229/117.16
2,200,320 A * 5/1940 Zalkind ..... A47B 88/906 229/199
2,220,076 A * 11/1940 Carruth ..... B65D 5/3664 229/175
2,229,425 A * 1/1941 Tanner ..... B65D 5/22 229/164
2,246,198 A * 6/1941 Zalkind ..... A47B 88/906 229/179
2,316,469 A * 4/1943 Nils ..... B65D 83/0882 225/48
2,367,008 A * 1/1945 Davidson ..... B65D 5/28 229/154
2,414,703 A * 1/1947 Snyder ..... B65D 5/22 229/168
2,418,963 A * 4/1947 Anderson, Jr. ..... B65D 5/0281 229/117.17
2,445,548 A * 7/1948 George ..... B21D 51/52 72/379.4
2,464,337 A * 3/1949 Morris ..... B65D 5/2047 229/165
2,502,561 A * 4/1950 Ebert ..... B65D 5/5253 206/767
2,547,628 A * 4/1951 Ellsworth ..... B65D 5/28 229/117.07
2,670,126 A * 2/1954 Frankenstein ..... B65D 5/248 229/176
2,702,155 A * 2/1955 Baumann ..... B65D 5/28 229/117.17
2,747,732 A * 5/1956 Fischer ..... B65D 5/5038 229/164
2,757,852 A * 8/1956 King ..... A47B 88/906 229/164
2,792,981 A * 5/1957 Grammer ..... B42F 7/14 229/164
2,796,978 A * 6/1957 Struble ..... B65D 5/5266 206/743
2,797,854 A * 7/1957 Myers ..... B65D 5/443 229/164
2,823,847 A * 2/1958 Barnes ..... B65D 5/3657 206/521.1
2,857,090 A * 10/1958 Fallert ..... B65D 5/22 229/160
2,934,252 A * 4/1960 Wickstrom ..... B65D 25/04 229/185
2,957,617 A * 10/1960 Bolding ..... B65D 5/3642 229/149
3,009,622 A * 11/1961 Leone ..... B65D 5/5021 229/120.17
3,187,980 A * 6/1965 Oas ..... B65D 5/685 229/125.26
3,193,427 A * 7/1965 Rogers ..... B65D 83/0882 225/2
3,236,410 A * 2/1966 Swartz ..... B65D 1/225 220/676
3,246,740 A * 4/1966 Guyer ..... B65D 5/28 229/160
3,254,824 A * 6/1966 Lang ..... B65D 5/4229 229/165
3,385,424 A * 5/1968 Thompson ..... B65D 5/5021 229/152
3,425,544 A * 2/1969 Ayer ..... B65D 71/10 229/164
3,430,839 A * 3/1969 McColl ..... B65D 5/323 229/122.26
3,477,624 A * 11/1969 Harshbarger ..... B65D 83/0841 225/80
3,545,665 A * 12/1970 Alexander ..... B65D 5/248 229/165
3,567,014 A * 3/1971 Feigelman ..... B65D 5/5246 229/172
3,669,339 A * 6/1972 Schilling ..... B65D 5/324 229/172
3,704,823 A * 12/1972 Howe ..... B65D 71/125 229/164
3,773,244 A * 11/1973 Dunlap, III ..... B65D 5/5021 206/335
3,881,648 A * 5/1975 Hall ..... B65D 5/2047 229/164
3,889,868 A * 6/1975 Bruckner ..... B65D 5/6661 229/125
3,900,157 A * 8/1975 Roth ..... B65D 5/0005 229/101
3,942,631 A * 3/1976 Sutherland ..... B65D 71/0048 53/48.9
3,949,928 A * 4/1976 Perkins ..... B65D 5/22 229/125.125
4,081,125 A * 3/1978 Meyers ..... B65D 25/04 229/114
4,350,281 A * 9/1982 Dornbusch ..... B65D 5/20 206/774
4,485,922 A * 12/1984 Desmond ..... B65D 5/5021 229/168
5,052,615 A * 10/1991 Ott ..... B65D 5/003 206/509
5,114,034 A * 5/1992 Miller ..... B65D 5/443 229/114
5,167,324 A * 12/1992 Miller ..... B65D 5/48014 229/242
5,180,052 A * 1/1993 Smith ..... B65D 5/5023 229/164
5,289,916 A * 3/1994 Mickelberg ..... B65D 5/4204 206/769
5,415,342 A * 5/1995 Harrelson ..... B65D 5/50 229/172
5,913,426 A * 6/1999 Lotz Renfro ..... B65D 5/5023 206/763
6,032,853 A * 3/2000 Chevalier ..... B65D 5/241 229/148
6,129,211 A * 10/2000 Prakken ..... B65D 5/5445 229/120.09
6,138,904 A * 10/2000 Baird ..... B65D 5/0075 229/199
6,145,665 A * 11/2000 Krahn ..... B65D 5/4208 229/162.1
6,158,653 A * 12/2000 Kanter ..... B65D 5/001 229/120.11
6,189,780 B1 * 2/2001 Kanter ..... B65D 5/542 229/164

(56) References Cited

U.S. PATENT DOCUMENTS

D461,125 S * 8/2002 Decello ..... D9/432
6,431,364 B1 * 8/2002 Saladyga ..... B65D 5/4241 206/767
6,729,475 B2 * 5/2004 Yuhas ..... B65D 5/5495 229/120.08
6,915,947 B2 * 7/2005 Siurek ..... B65D 5/0005 229/101
7,237,678 B2 * 7/2007 Lo Duca ..... B65D 5/5014 206/781
7,581,672 B1 * 9/2009 Keefe ..... B65D 5/443 229/164
7,624,876 B1 * 12/2009 Green ..... B65D 75/322 206/764
7,708,187 B2 * 5/2010 Keefe, Jr. ..... B65D 5/18 229/172
7,837,090 B2 * 11/2010 Bostian ..... B65D 5/0045 229/179
7,981,017 B2 * 7/2011 Little ..... B65D 5/0075 493/69
8,028,839 B2 * 10/2011 Learn ..... B65D 5/725 206/774
8,220,633 B2 * 7/2012 Weideman ..... B65D 5/0015 206/509
8,302,845 B2 * 11/2012 Bell ..... B65D 5/4225 229/103
8,596,455 B2 * 12/2013 Babcock ..... B65H 55/046 242/588
8,596,460 B2 * 12/2013 Scatterday ..... A24F 15/02 229/164
8,844,728 B2 * 9/2014 James ..... B65D 5/5445 206/774
8,939,290 B2 * 1/2015 DeCello ..... B65D 5/5445 220/240
8,985,336 B1 * 3/2015 Yost ..... B31B 50/26 229/122.34
9,205,947 B1 * 12/2015 Waldschmidt ..... B65D 5/445
9,238,523 B1 * 1/2016 Frost ..... B65D 5/505
9,440,763 B1 * 9/2016 Einstein ..... B65D 5/5035
9,718,575 B2 * 8/2017 Bourdin ..... B65D 5/22
9,873,543 B2 * 1/2018 Earnshaw ..... B65D 5/248
9,938,038 B2 * 4/2018 Pfeifer ..... B65D 5/4216
10,159,361 B2 * 12/2018 Jolley ..... A47F 5/114
10,829,263 B1 * 11/2020 Little ..... B65D 5/4266
11,161,644 B2 * 11/2021 Moss ..... B65D 5/22
11,325,741 B1 * 5/2022 Philips ..... B65D 5/001
2003/0160091 A1 * 8/2003 Hearne ..... B65D 5/4204 229/164
2005/0109670 A1 * 5/2005 Loew ..... A47F 5/112 206/736
2006/0048486 A1 * 3/2006 Laing ..... B65D 25/107 108/51.11
2008/0054061 A1 * 3/2008 Bostian ..... B65D 5/0045 229/185.1
2008/0078821 A1 * 4/2008 Keefe ..... B65D 5/18 229/164
2008/0078822 A1 * 4/2008 Keefe ..... B65D 5/443 229/172
2008/0197179 A1 * 8/2008 Weimer ..... B65D 5/4204 53/448
2009/0223857 A1 * 9/2009 Bowman ..... B65D 5/48042 493/162
2009/0283580 A1 * 11/2009 Little ..... B65D 5/48014 493/320
2009/0308786 A1 * 12/2009 Urban ..... B65D 5/5273 206/750
2010/0083618 A1 * 4/2010 Little ..... B65D 5/4608 53/450
2010/0243517 A1 * 9/2010 Agalopoulos ..... B65D 5/0254 206/746
2012/0091031 A1 * 4/2012 Pinkstone ..... B65D 5/0015 229/103
2012/0152788 A1 * 6/2012 Scanzillo ..... B65D 5/4608 220/639
2012/0187025 A1 * 7/2012 Bowman ..... B65D 5/48044 206/756
2013/0168287 A1 * 7/2013 James ..... B65D 5/5021 206/763
2013/0334295 A1 * 12/2013 Swenson ..... B65D 5/542 229/122
2014/0263353 A1 * 9/2014 Bell ..... B65D 5/4295 229/148
2016/0122073 A1 * 5/2016 Aguirre ..... B65D 5/443 206/509
2016/0144994 A1 * 5/2016 Flaming ..... B65D 5/0015 206/509
2016/0318653 A1 * 11/2016 Pfeifer ..... B65D 5/5038
2017/0183118 A1 * 6/2017 Earnshaw ..... B65D 5/4279
2017/0217627 A1 * 8/2017 Earnshaw ..... B65D 5/4266
2017/0217629 A1 * 8/2017 Buscema ..... B65D 5/20
2019/0118995 A1 * 4/2019 Page ..... B65D 5/0075
2019/0322408 A1 * 10/2019 Burda ..... B65D 5/48002
2020/0189788 A1 * 6/2020 Cline ..... B65D 5/20
2021/0185791 A1 * 6/2021 Nazzaro ..... B65D 5/6664
2021/0284377 A1 * 9/2021 Couture ..... B65D 5/4608
2021/0347528 A1 * 11/2021 Drummond ..... B65D 5/5023
2022/0053900 A1 * 2/2022 Antonyan ..... A45C 11/20
2022/0111996 A1 * 4/2022 Nash ..... B65D 5/18
2023/0097423 A1 * 3/2023 López Masagué .. B65D 5/6685 229/117.12

* cited by examiner

BLANK FOR FORMING A SHIPPING CARTON WITH AN INTEGRATED DISPLAY TRAY

CROSS-REFERENCE TO RELATED APPLICATIONS

This application is a divisional of U.S. application Ser. No. 17/246,991, filed May 3, 2021, which claims the benefit of U.S. Provisional Patent Application No. 63/020,056, filed May 5, 2020, both of which are expressly incorporated by reference herein.

BACKGROUND OF THE INVENTION

The present disclosure concerns embodiments of a one-piece blank that can be easily and assembled into a shipping carton with an integrated display tray for transporting consumer items.

The modern supply chain for retail items requires the safe and efficient delivery of items from the manufacturer, to the distributor, to the logistics or delivery service, and ultimately to the retailer. For most products, the delivery chain will involve bundling the product with similar or identical products for shipping in mass quantities, whether by carton, pallet, or other means. Additionally, once the retailer receives the items, they must be displayed in the retail outlet in a way that is visible and accessible to consumers. Whether set out on stock shelves or in stand-alone displays or end caps, the product must be visible to the end consumer.

Frequently, retailers must remove the individual items from their shipping containers or crates, and place them on stock shelves, even for products that are delivered in smaller, self-contained packages. This traditional means of delivery and stocking creates additional waste of time and materials, as a clerk must remove the item in its final packaging from the shipping crate and then place the item neatly in an organized and visually pleasing array. Furthermore, items may be shipped in final packaging that is odd-shaped or ill-suited for organization in rows and columns on stock shelves. For example, manufacturers, often package odd-shaped items like disposable razors and vitamin canisters within a blister pack. The blister pack may set the item near the center of a larger, planar board made from card stock, corrugated cardboard, foam board, or rigid plastic. Such an arrangement is advantageous because it provides a large surface to surround and protect the item from sources of impact or damage, reduces the required packaging materials when compared to common prismatic boxes, and provides an increased surface area for displaying advertising and marketing information for the product. Unfortunately, blister packs have an odd shape that does not fit neatly into larger shipping containers. The present invention seeks, in part, to capitalize on the benefits of blister packaging while also reducing material waste, and stocking time.

While cartons adapted for transporting and displaying items packaged in a blister pack within a tray, many of the known examples require one, two or even three separate parts that must be assembled to form the shipping crate. Accordingly, it is desirable to provide a blank for shipping cartons that integrates both the exterior walls of the shipping carton and the interior supports for displaying consumer items into a single blank, thus reducing waste and assembly time while increasing durability and strength and providing increased surface area for graphics or advertising copy.

SUMMARY OF THE INVENTION

In one aspect, a foldable blank for forming a carton for shipping and displaying a plurality of products is provided.

The blank includes an exterior rear panel, an exterior floor panel foldably connected to the exterior rear panel, an exterior front panel foldably connected to the exterior floor panel, an interior front panel foldably connected to the exterior front panel, a first and second exterior side panel both foldably connected to the rear panel, a first and second interior floor panel each foldably the first and second side panels, respectively, the interior front panel defining a plurality of tabs, and the interior floor panels defining a recess for receiving the tabs in order to position the interior floor panels relative to the exterior floor panel to form a double-layered floor and further position the front wall panels to form a double layer front wall, and the rear wall panel, first and second exterior side panels, double-layered floor, and front wall define a generally rectangular prismatic recess adapted to receive a plurality of products.

In another aspect, a foldable blank for forming a carton for shipping and displaying a plurality of products is provided. The blank includes a rear panel, a first and second side panels both foldably connected to the rear panel, an exterior floor panel foldably connected to the rear panel, and a front panel foldably connected to the floor panel that is less than half the vertical height of the rear, first side, and second side panels and defines at least one retaining tab, wherein when the blank is folded to form the carton, each of the rear panel, first and second side panels, and front panel are at least partially double-walled.

BRIEF DESCRIPTION OF THE DRAWINGS

Several embodiments of the invention will now be described in detail with reference to the accompanying drawings, wherein similar elements are referred to with similar reference numerals.

DETAILED DESCRIPTION

The singular terms "a," "an," and "the" include plural referents unless context clearly indicates otherwise. The term "comprises" means "includes." In case of conflict, the present specification, including explanations of any terms, will control.

Figure 1:
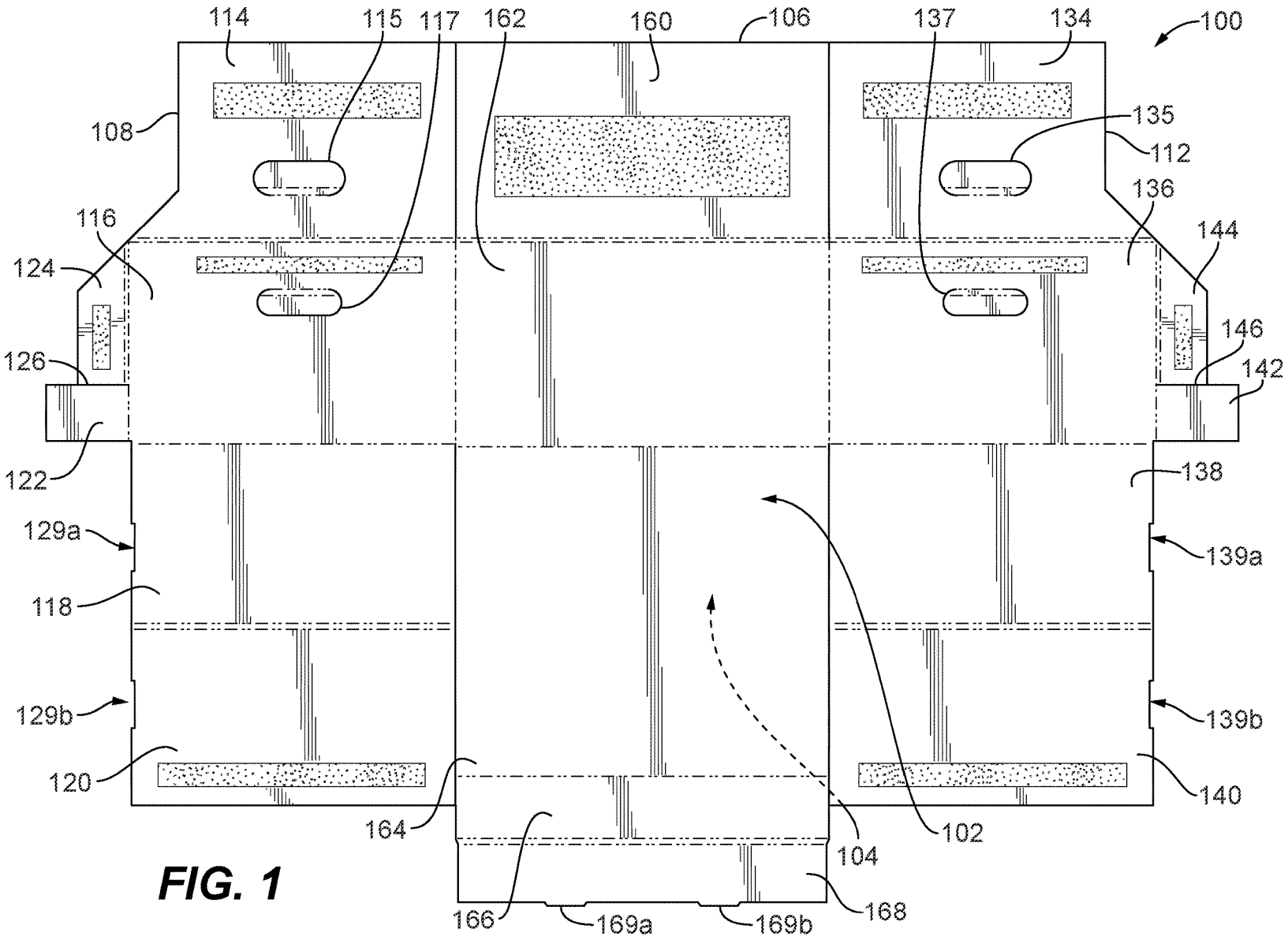
FIG. 1 is a top plan view of a blank of sheet material for forming an exemplary embodiment of a shipping carton described herein.
Figure 2:
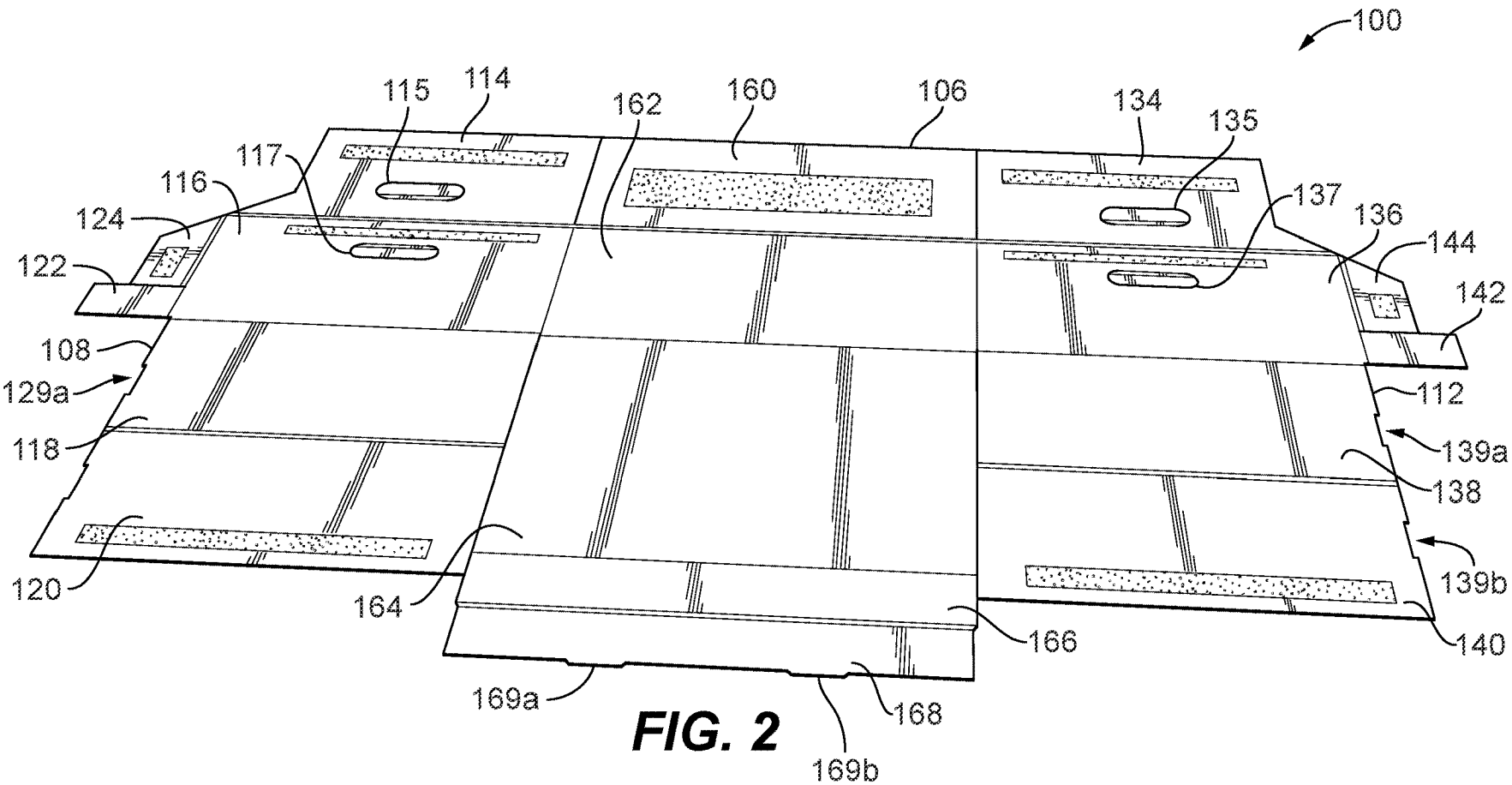
FIG. 2 is a top perspective view of the blank of sheet material shown in FIG. 1.
Figure 7:
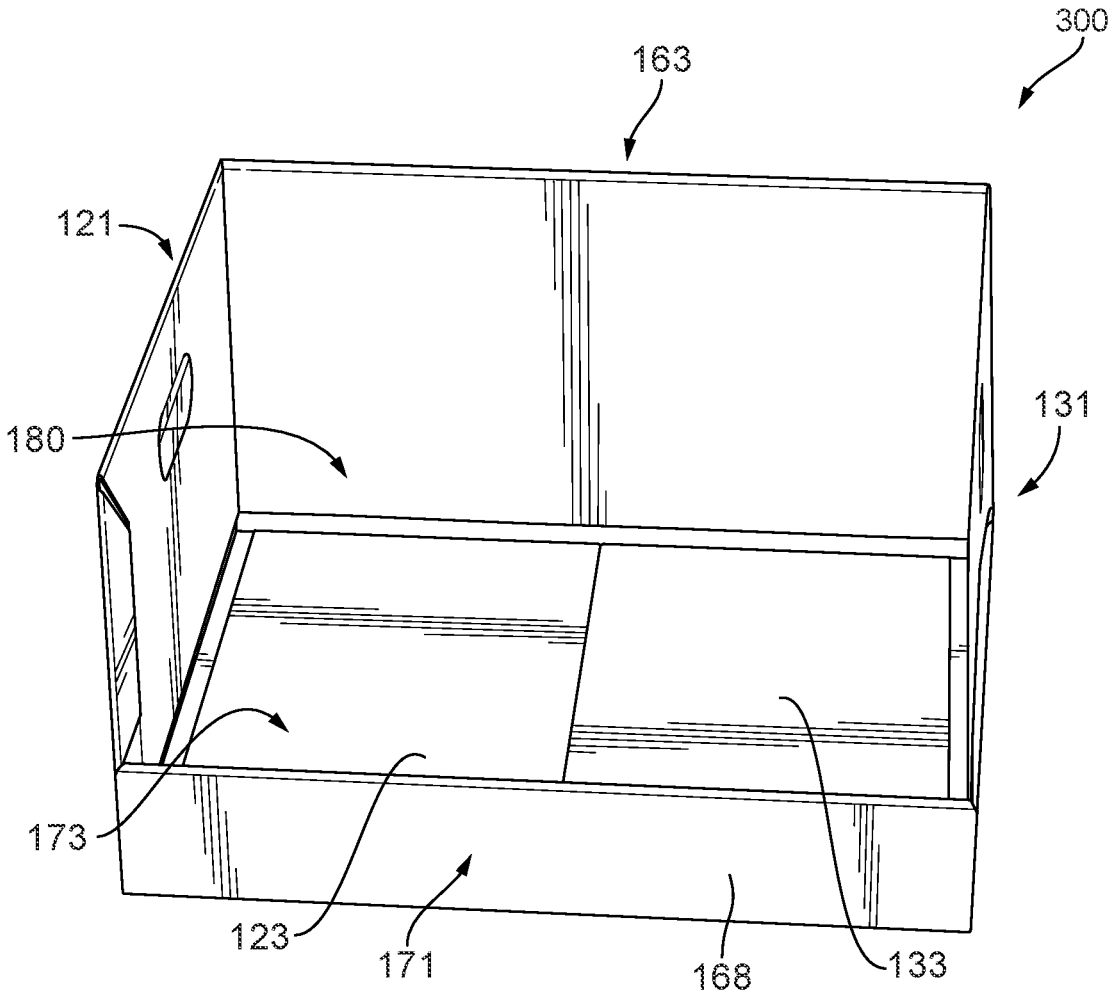
FIG. 7 is a perspective view of a fully assembled shipping carton formed from the blank shown in FIG. 1.

FIG. 1 is a top view of an exemplary blank 100 of sheet material for forming a shipping and display carton 300 (shown in a fully erected arrangement in FIG. 7); FIG. 2 likewise shows blank 100 from a top perspective view. Blank 100 has an interior surface 102 and an opposing or exterior surface 104. Blank 100 further defines a first perimeter edge 106, a second perimeter edge 108, a third perimeter edge 110, and a fourth perimeter edge 112, which together define blank 100'*s* generally rectangular perimeter. Edges 106, 108 and 110 together define, in part, a left-most column of panels: a left interior side panel 114, left exterior side panel 116, left interior floor panel 118, and an optional left glue panel 120. The panels described immediately above are demarcated by a series of pre-formed, generally parallel fold lines, which may include any suitable line of weaking or folding known by those skilled in the art and guided by the teachings provided herein. In the preferred embodiment, an optional support tab 122 and an optional glue panel 124 may extend leftward from panel 116, tab 122 and panel 116 being demarcated from panel 116 by a fold line and demarcated from each other by a cut line 126 which may be formed from any suitable line for separating adjacent panels known by those skilled in the art, such as perforations or complete cuts. Additionally, panels 118 and 120 may each define an edge recess 129*a*, 129*b* colinear with first edge 108, the purposes of which will be discussed below. Glue, hot-melt, or other adhesive materials commonly known to those skilled in the art may be applied to one or more of panels 114, 116, 118, 120 and 124 for adherence to their mating surfaces during carton assembly as described below (adhesive material represented by the conventional symbol for adhesives as indicated).

Similarly, edges 106, 112 and 110 together define, in part, a right-most column of panels within blank 100: a right interior side panel 134, right exterior side panel 136, right interior floor panel 138, and an optional right glue panel 140. As with the panels of the left-most column, the panels described immediately above are preferably demarcated by a series of pre-formed, generally parallel fold lines. In the preferred embodiment, a support tab 142 and an optional glue panel 144 may extend rightward from exterior wall panel 136, tab 142 and panel 144 being demarcated from panel 136 by a fold line and demarcated from each other by a cut line 146. Additionally, panels 138 and 140 may each define an edge recess 139*a*, 139*b* colinear with first edge 112, the purposes of which will be discussed below. Glue, hot-melt, or other adhesive materials may be applied to one or more of panels 134, 136, 140, and 144 for adherence to their mating surfaces during carton assembly as described below.

Between the left-most and right-most column of panels described above lies a central column of panels: rear wall interior panel 160, which may have adhesive material 161 applied thereto, rear wall exterior panel 162, exterior floor panel 164, front wall exterior panel 166, and front wall interior panel 168, which are demarcated by a series of pre-formed, generally parallel fold lines as shown. Additionally, panel 160 is separated from each of panels 114, 134 by a pair of generally parallel, pre-formed cutlines that are generally perpendicular to edge 106. Panels 164 and 166 are preferably demarcated on the left-hand side from each of panels 118, 120 and on the right-hand side from each of panels 138, 140 by a pair of generally parallel, pre-formed cut lines that are generally perpendicular to edge 110. Rear wall exterior panel 162 is demarcated from each of panels 116, 136 by a pair of generally parallel, pre-formed fold lines. The placement of cutlines and fold lines between adjacent panels allows for these panels to cleanly separate from each other when blank 100 is folded into its fully-assembled arrangement as a shipping carton as described in greater detail below with regard to FIGS. 3 and 4.

In some embodiments, panels 114, 116, 134, and 136 may define a respective optional perforated handle holes 115, 117, 135, and 137 each of which may be defined by a perforated cut line such that a consumer, stocking clerk, or other person may punch out the material within the handle holes thus creating a hole adapted for being grasped by the human hand as commonly known in the art to assist in transport or handling of the carton.

Figure 3:
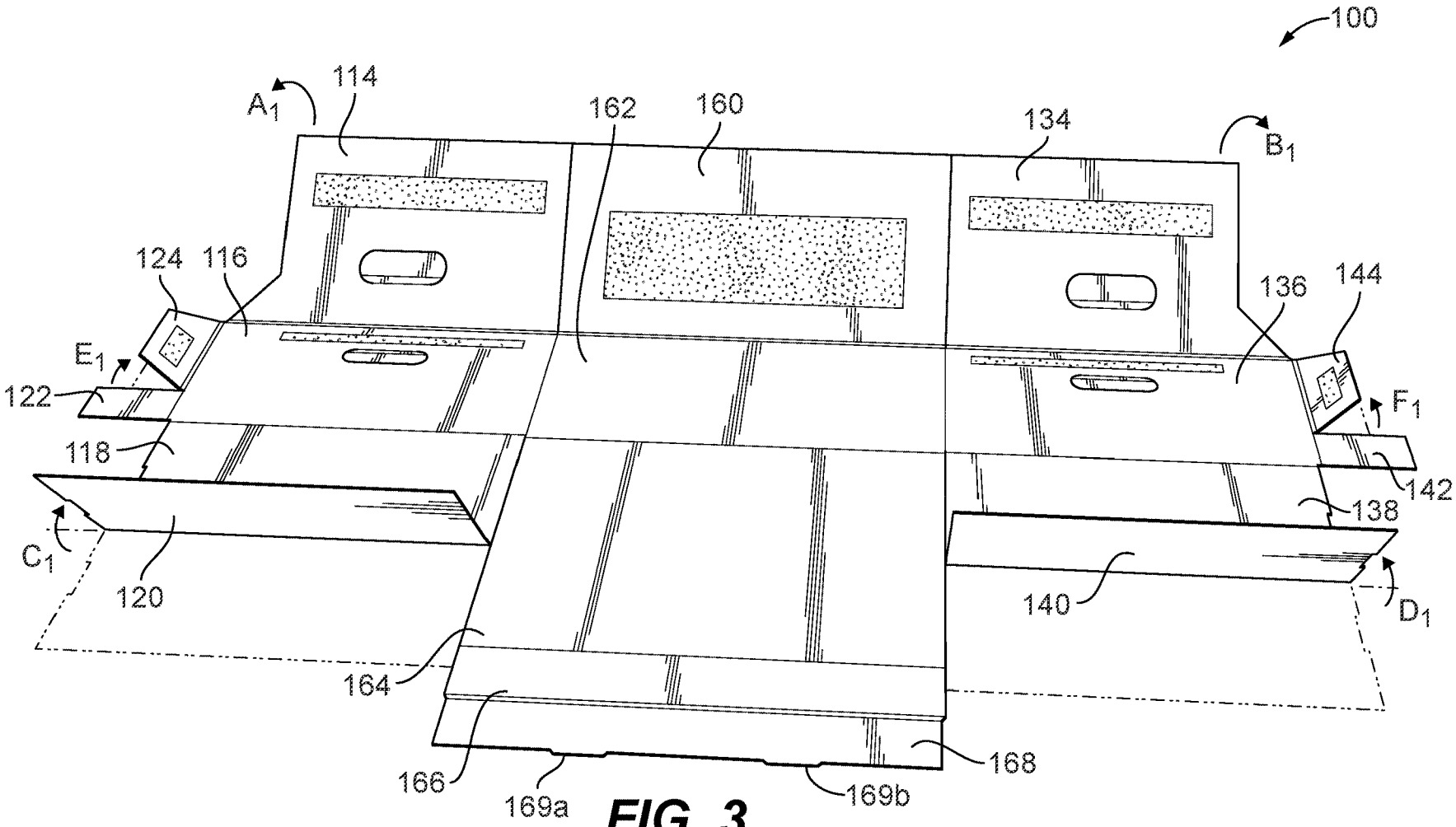
FIG. 3 is a top perspective view of the blank a shown in FIG. 1 in a partially assembled arrangement.
Figure 4:
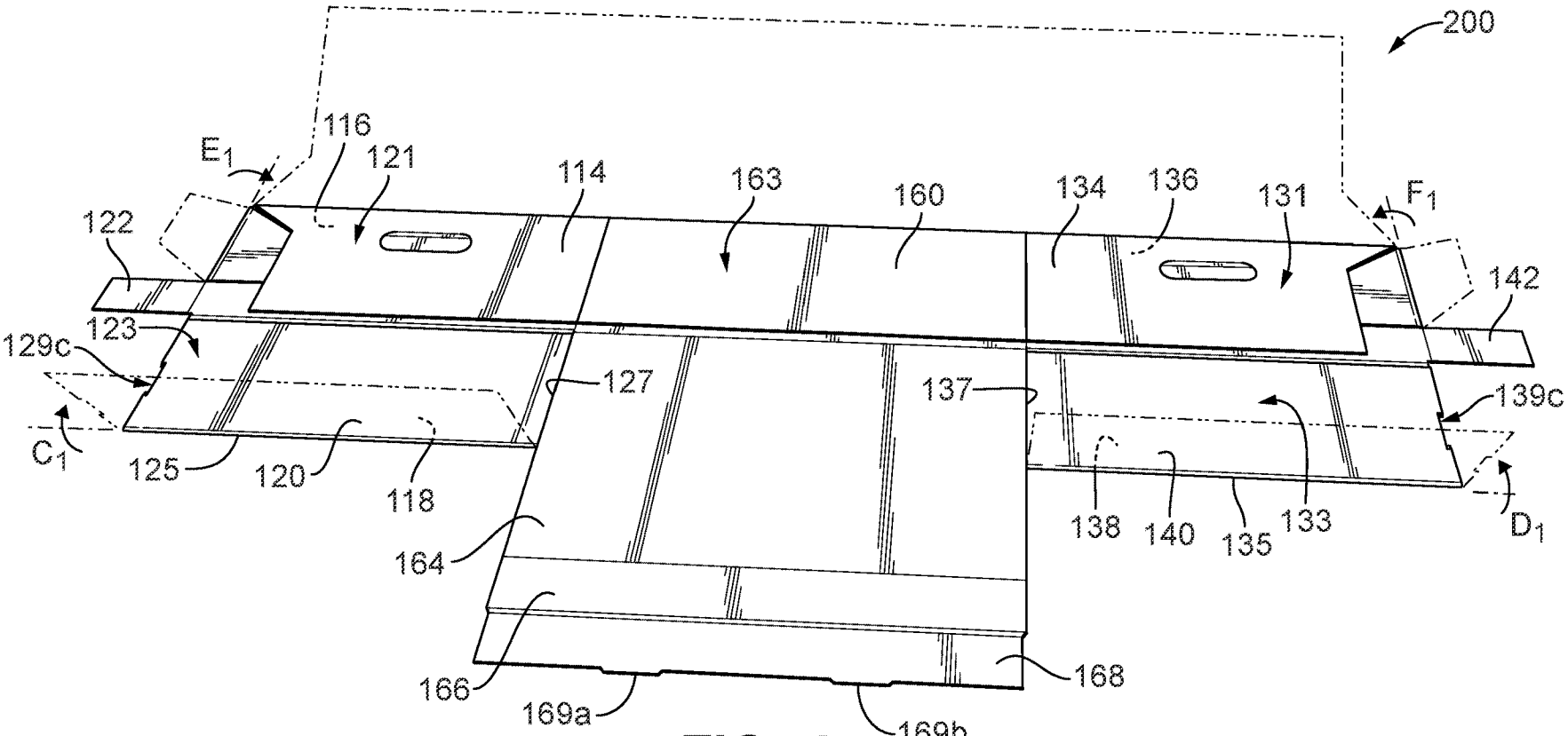
FIG. 4 is a top perspective view of the blank a shown in FIG. 1 in a partially assembled arrangement.

FIGS. 3-4 show how panels of blank 100 may be manipulated in order to form the knocked-down carton 200 (shown in FIG. 4). It is noted that, although the new reference numeral 200 is presented, features previously disclosed with respect to carton blank 100 and knocked-down carton 200 are designated with the same reference numerals previously used in FIGS. 1 and 2. FIG. 3 shows a top perspective view of blank 100 in a pre-assembly arrangement, with panels 114, 160, and 134 folded slightly inward toward panels 122, 172, and 152 as indicated by arrows $A_1$ and $B_1$, respectively, along their respective fold lines. Optional panels 124 and 144 are folded inwardly toward exterior wall panels 116 and 136 as indicated by arrows $E_1$ and $F_1$, respectively, and optional panels 120, 140 are folded inward toward panels 118 and 138 as indicated by arrows $C_1$ and $D_1$, respectively. It should be appreciated that the dashed lines in FIGS. 3-4 indicate the position of the various panels from which they are fold to form knocked-down carton 200. Once completely folded inwardly as shown in FIG. 4, adhesive material (indicated by the conventional symbol for adhesives) applied to panels 114 and 124 adheres to panel 116, and the adhesive material (likewise indicated by the conventional symbol for adhesives) applied to panels 124 and 144 also adheres to panel 116 and 136, respectively. Similarly, the adhesive material (visible in FIGS. 1 and 2) applied to glue panels 120 and 140 adheres to panel 118 and 138, respectively. In this way the left-most column of panels creates a series of double-walled support with panels 114 and 116 forming left sidewall 121, panels 118 and 120 together forming left interior floor 123 which defines edges 125 and 127. Additionally, folding 118 and 120 together allows edge recesses 129*a* and 129*b* (FIG. 1) align and together define edge recess 129*c*. Similarly, panels 134 and 136 fold together to form right sidewall 131, and panels 138 and 140 fold together form right interior floor 133 which defines an edge 135, 137, and 139*a* and 139*b* (FIG. 1) align and together define edge recess 139*c*. Similarly, panel 160 folds inward toward panel 162 such that the adhesive material adheres the panels together forming a double-layered rear wall 163. Once completely folded as described above, blank 100 assumes its pre-assembly form as a knocked-down carton 200 shown in FIG. 4. Beneficially, knocked-down carton 200 remains flat, occupies far less surface space than in its un-assembled form shown in FIGS. 1-2, and thus may be stowed to await final assembly. Additionally, it should be appreciated that as a result of the manner in which blank 100 (FIGS. 1-2) is folded into knocked-down carton 200, the visible surfaces of all panels shown in the perspective view shown in FIG. 4 as well as underside (not visible but identified as 201) are part of exterior surface 104 referenced earlier in regard to FIG. 1. This feature will become apparent in the discussion of the fully-erected carton discussed in further detail below.

While the preferred embodiment utilizes adhesive materials to adhere blank panels together, it should be appreciated that any commonly known alternative method of binding panels may be substituted, such as rivets, brads, tacks, staples and the like. Furthermore, conversion of blank 100 into knocked-down carton 200, as discussed above, may be accomplished in any convention manner, for example, in a conventional folder-glue machine as is well-known in the industry.

Figure 5:
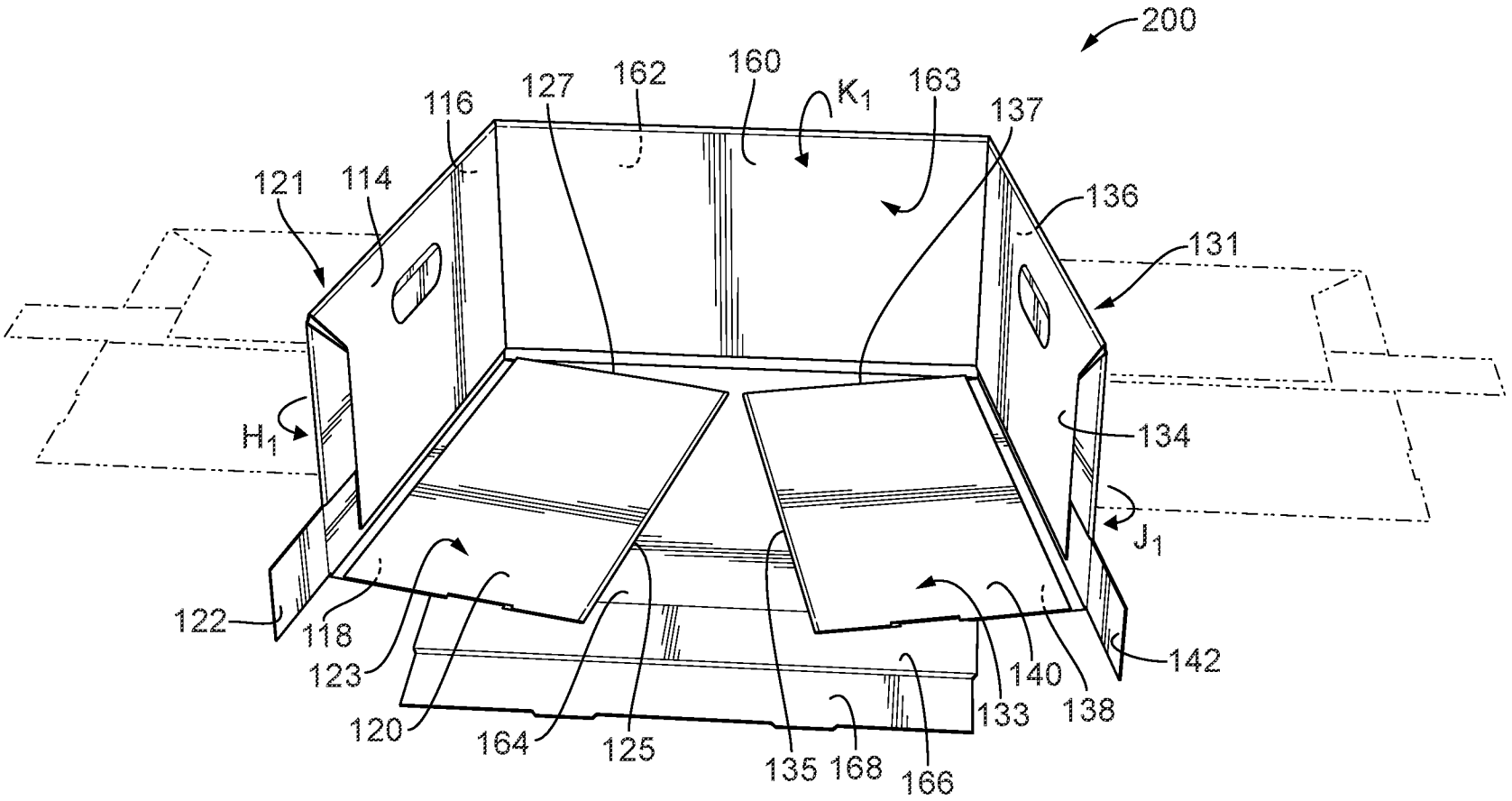
FIG. 5 is a top perspective view of the blank a shown in FIG. 1 in a partially assembled arrangement.
Figure 6:
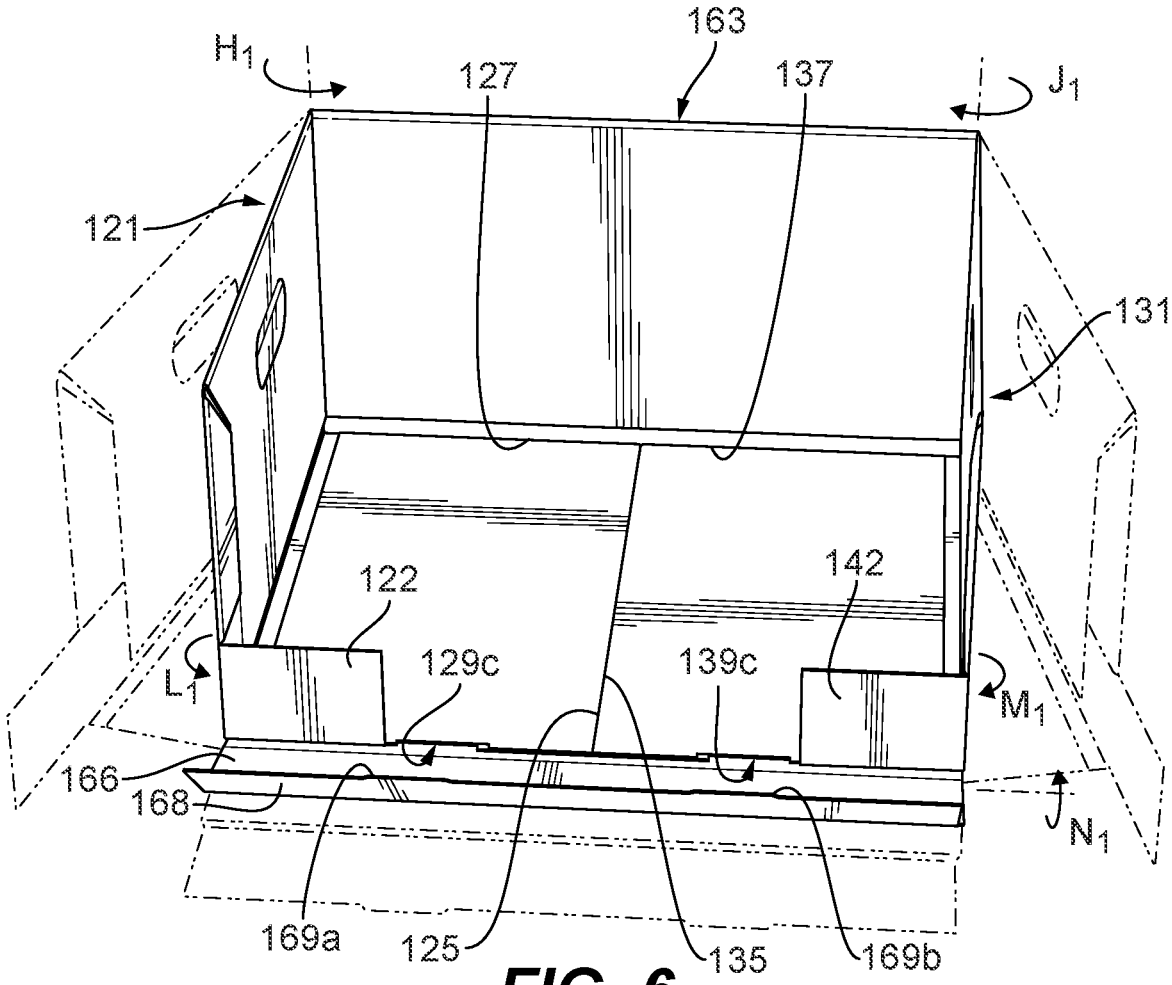
FIG. 6 is a top perspective view of the blank a shown in FIG. 1 in a partially assembled arrangement.

FIGS. 5, 6, and 7 depict the progression through which knocked-down carton 200 is assembled into fully-erected carton 300 (FIG. 7). While new reference numeral 300 is used denote the erected carton, features previously disclosed with respect to carton blank 100 and knocked-down carton 200 in FIGS. 1-4 are designated with the same reference numerals used. Additionally, it should be appreciated that the dashed lines in lines in FIGS. 5-7 indicate the positions of the various panels from which they are folded in order to form the fully-erected carton.

With regard to FIG. 5, panels 121, 123 are folded up an inward along arrows $G_1$ and $H_1$, panels 131 and 133 are folded up an inward along arrows $I_1$ and $J_1$, and rear wall 163 is folded upward as indicated by arrow $K_1$. Floor panels 123 and 133 rest atop floor panel 164. Beneficially, an assembly technician or warehouse worker can grasp panel 123 in one hand and 133 in the other hand and with a quick motion as indicated by arrows $G_1$, $H_1$, $I_1$, and $J_1$ fold the knocked-down carton 200 (FIG. 4) into the arrangement shown in FIG. 5. As the blank is folded, rear wall 163 folds along the pre-formed fold line between wall 163 and panel 164, sidewalls 121 and 131 and wall 163 each assume a largely vertical arrangement, relative to panel 164, and floor panel edges 125, 135 begin to approach each other.

Turning to FIG. 6, panels 121 and 123 have been folded completely inward along arrow $H_1$ and panels 131 and 133 have been folded completely inward along arrow $J_1$ such that panel edges 125 and 135 abut or nearly abut each other and edges 127, 137 both abut wall 163. Panels 122 and 142 are folded inward along arrows Li and Mi, until they come into contact with the double-thickness of floor panels 123, 133 and cannot be folded further without resulting doing damage to or creating unwanted creases in one or more of panels 122, 123, 133, or 142. Panels 166 and 168 are folded in the direction of arrow $N_1$ such that panels 122 and 142 are sandwiched between panels 166 and 168 and retaining tabs 169*a*, 169*b* approach edge recesses 129*c*, 139*c*.

When knocked-down carton 200 is completely folded into erected carton 300 as shown in FIG. 7, retaining tabs 169*a*, 169*b* releasably engage recesses 129*c*, 139*c* (FIG. 6) thereby giving the entire carton structural rigidity. Thus, panels 166 and 168 together form a low front wall 171 for the carton that is, preferably, less than one-half the height of panels 121, 163, and 131. When fully assembled, carton 300 has vertical walls 121, 163, 131, and 171, each of which is largely double-walled, a triple-walled floor 173, and an accessible inner chamber 180 into which various items may be loaded for transport to and display at the point of sale.

Figure 8:
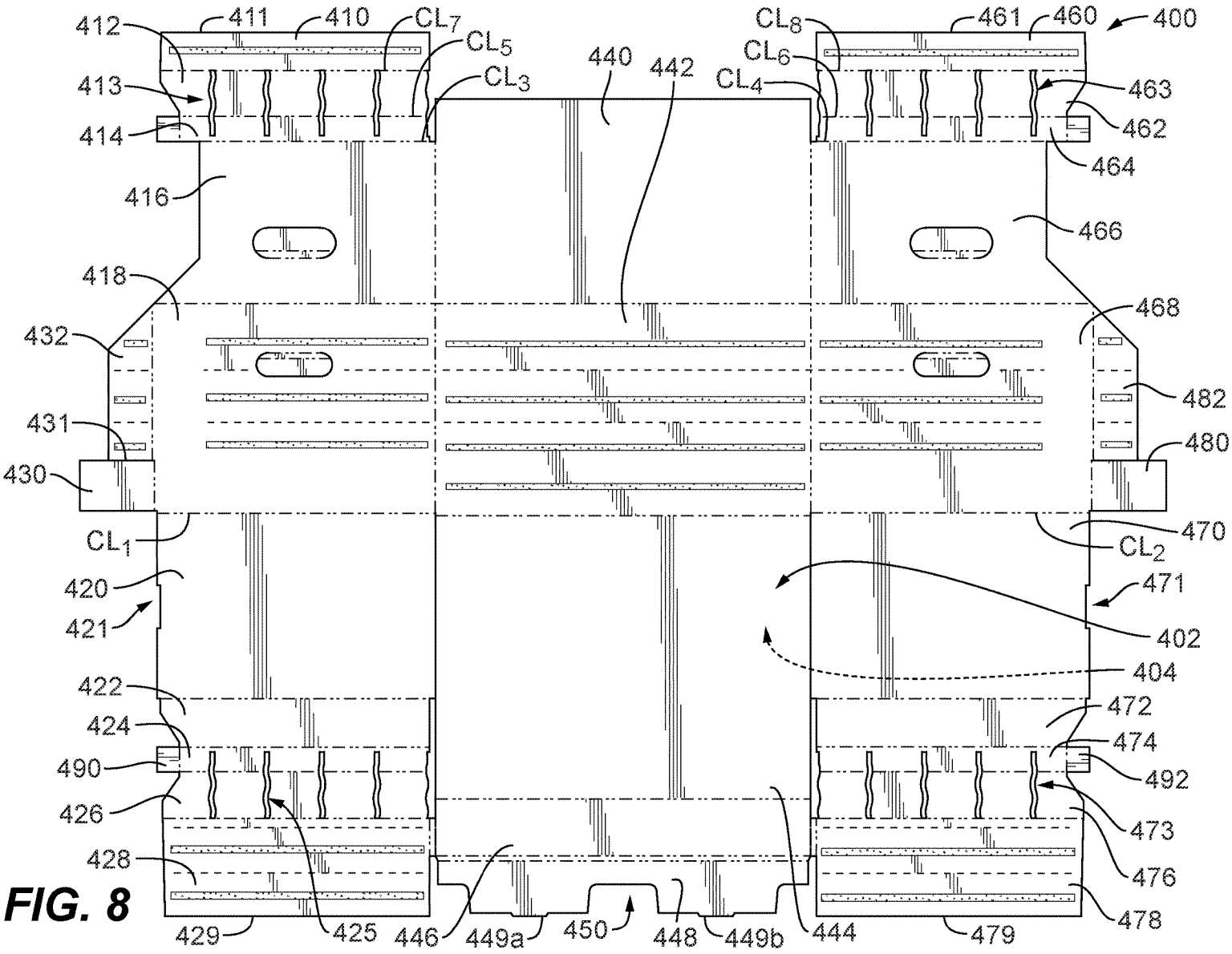
FIG. 8 is a top plan view of a blank of sheet material for forming a second exemplary embodiment of a shipping carton described herein.
Figure 9:
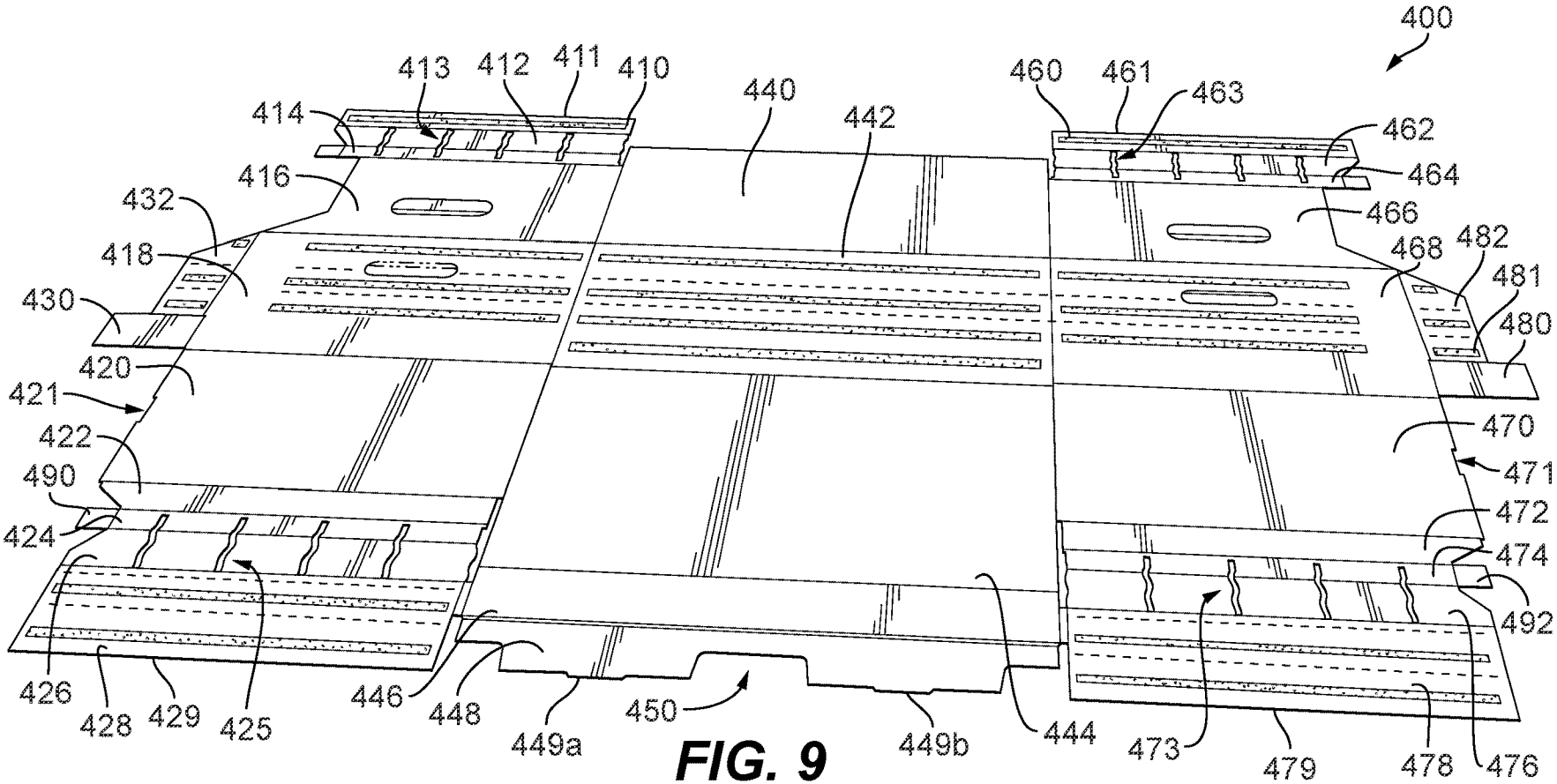
FIG. 9 is a top perspective view of the blank of sheet material shown in FIG. 8.
Figure 14:
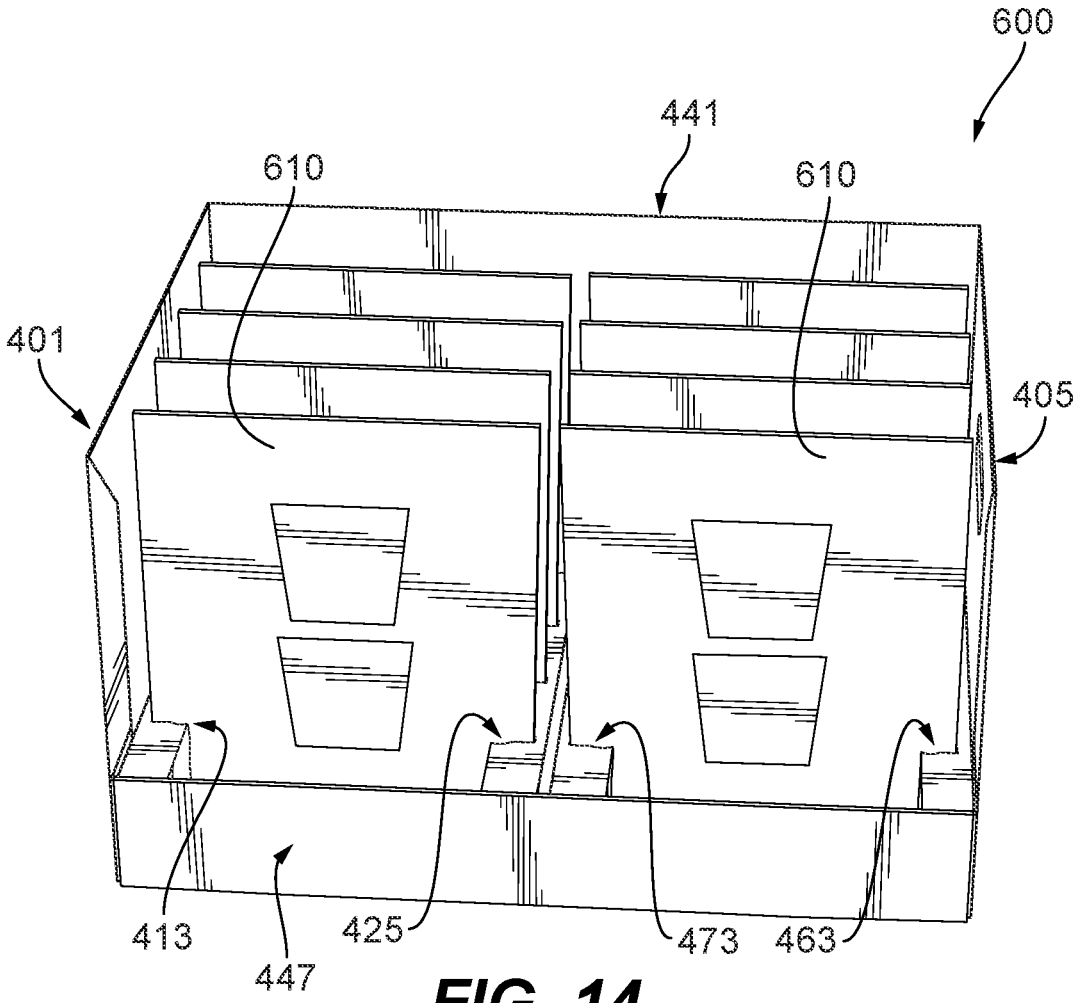
FIG. 14 is a perspective view of a fully assembled shipping carton formed from the blank shown in FIG. 8 filled with exemplary products.

FIG. 8 is a top view of a second embodiment of an exemplary blank 400 of sheet material for forming a shipping and display carton 600 (FIG. 14) capable of securing packaged items arranged in an array as indicated in FIG. 14; FIG. 9 likewise shows blank 400 from a top perspective view. As in the previously described embodiment, blank 400 has an interior surface 402 and an opposing or exterior surface 404. Blank 400 preferably comprises a left-most column of panels: panel 410 that defines an interior edge 411, first divider panel 412, second divider panel 414, left interior wall panel 416, left exterior wall panel 418, left interior floor panel 420 preferably defining a retaining recess 421 and edge 427, left central support panel 422, third divider panel 424 with a foldable alignment tab 490 extending leftward therefrom, fourth divider panel 426 (each of panels 422, 424, 426, being optional), and a second glue panel 428 that defines an interior edge 429. The panels described immediately above are demarcated by a series of pre-formed, generally parallel fold lines, which may include any suitable line of weaking or folding known by those skilled in the art and guided by the teachings provided herein; however, special reference is made to crease lines $CL_1$ (between panels 418, 420), $CL_2$ (between panels 468, 470), $CL_3$ (between panels 414, 416) $CL_4$ (between panels 464, 466), $CL_5$ (between panels 412, 414), $CL_6$ (between panels 462, 464), $CL_7$ (between panels 410, 412), and $CL_8$ (between panels 460, 462), which will be discussed in further detail in connection with FIG. 12. As described above in connection with the prior embodiment, a support tab 430 and an optional glue panel 432 may extend leftward from exterior wall panel 418, tab 430 and panel 432 being demarcated from panel 418 by a fold line and demarcated from each other by a cut line 431 which may be formed from any suitable line for separating adjacent panels known by those skilled in the art, such as perforations or complete cuts. Glue, hot-melt, or other adhesive materials commonly known to those skilled in the art may be applied to one or more of panels 410, 416, 418, 420, 428, and 432 for adherence to their mating surfaces during carton assembly as described below (adhesive material is represented by the conventional symbol for adhesives). Panels 412 and 414 define a plurality of support slits exemplified by slit 413, and panels 424 and 426 define a similar plurality of support slits exemplified by slit 425, the purposes of which will become apparent later in this disclosure.

Blank 400 preferably also comprises a central column of panels: rear interior panel 440, rear exterior panel 442, exterior floor panel 444, front exterior panel 446 and front interior panel 448 that defines a pair of retaining tabs 449*a*, 449*b*, and an optional alignment recess 450. A right most column of panels comprises, in order, panels 460, 462, 464, 468, and 470, optional panels 472, 474 (with a foldable alignment tab 492 extending rightward therefrom), and 476, panels 478, 480, and optional panel 482 that are symmetrical and largely identical to the panels of the left-most column of panels described above. Adhesive materials commonly known to those skilled in the art may be applied to one or more of panels 460, 466, 468, 470, 478 and 482 for adherence to their mating surfaces during carton assembly as described below. Panel 460 defines edge 461, panel 470 defines edge 477, and 478 defines edge 479, and panel 470 defines a retaining recess 471. As with the panels of the left-most column the panels of the central column and right-most column are preferably demarcated by a series of pre-formed fold lines. Panels 462 and 464 define a plurality of support slits 463*a-d*, and panels 474 and 476 define a similar plurality of support slits exemplified by slit 475, the purposes of which will become apparent later in this disclosure.

Figure 10:
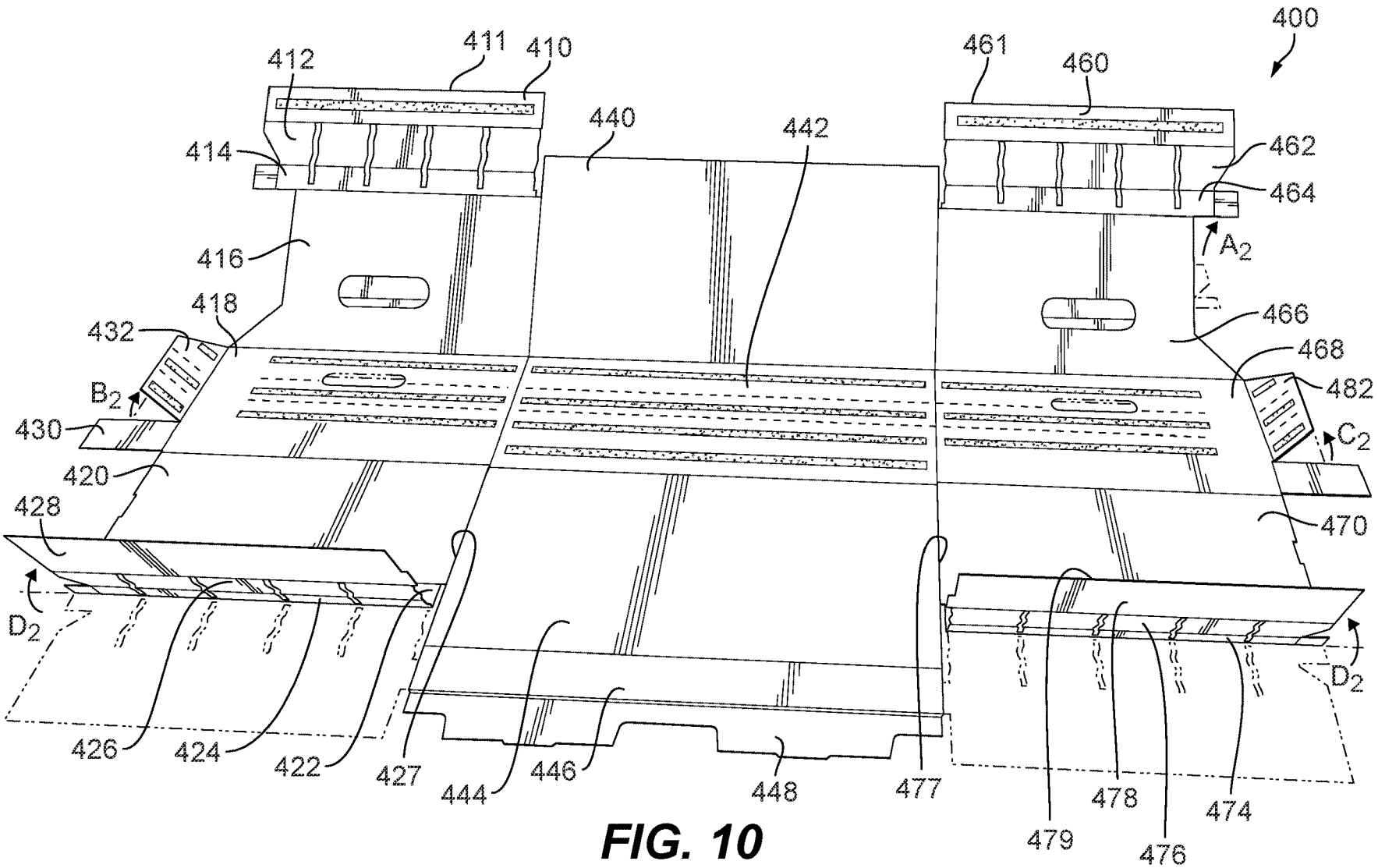
FIG. 10 is a top perspective view of the blank a shown in FIG. 8 in a partially assembled arrangement.
Figure 11:
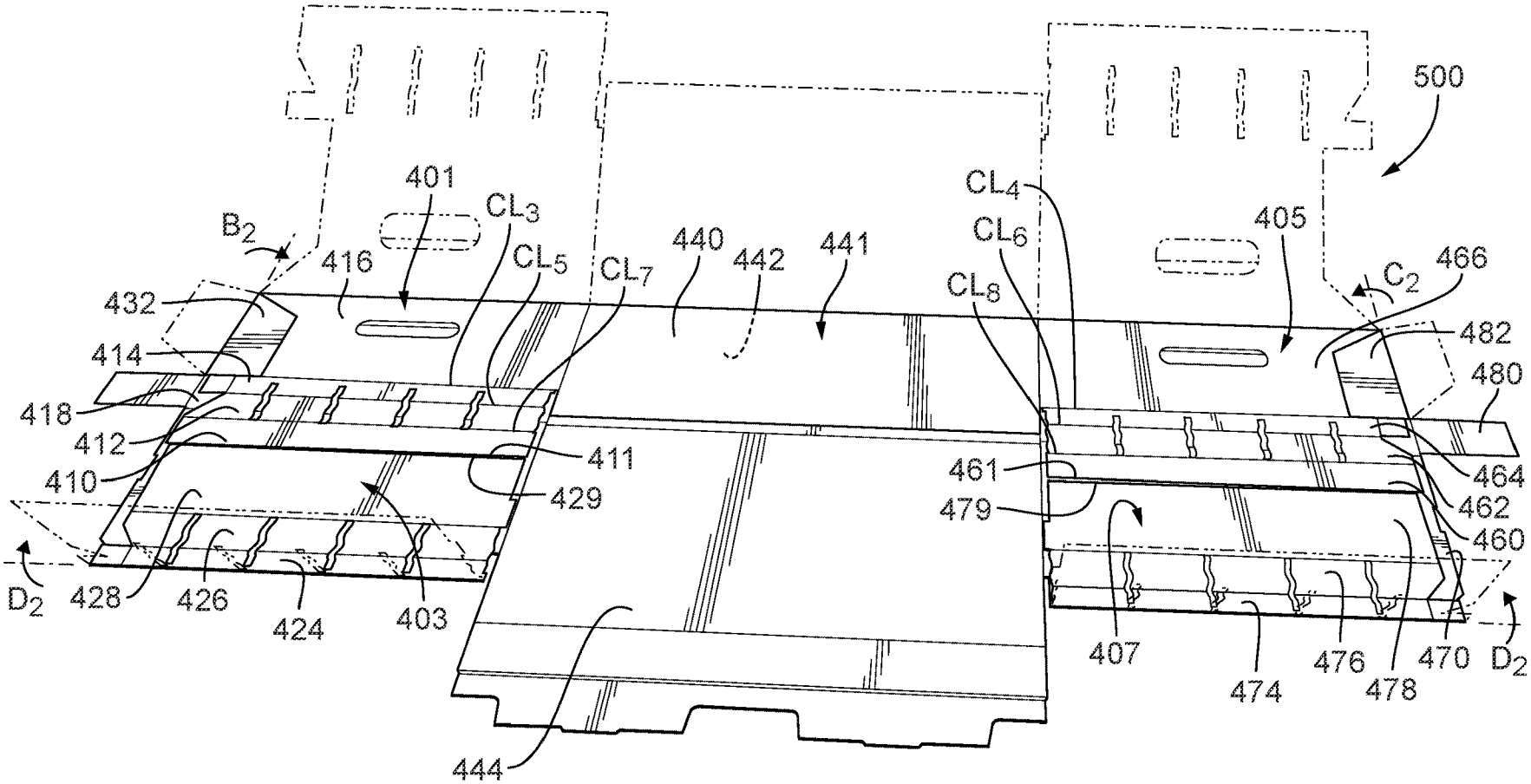
FIG. 11 is a top perspective view of the blank a shown in FIG. 8 in a partially assembled arrangement.

FIGS. 10-11 show how the panels of blank 400 may be manipulated in order to form the knocked-down carton 500 (shown in FIG. 11). It is noted that, although the new reference numeral 500 presented, features previously disclosed with respect to carton blank 400 and knocked-down carton 500 are designated with the same reference numerals previously used in FIGS. 8 and 9. FIG. 10 shows a top perspective view of blank 400 in a pre-assembly arrangement, with panels 416, 440, and 466 slightly folded inward toward panels 418, 442, and 468 respectively as indicated by arrow $A_2$, along their respective fold lines. Optional glue panels 432 and 482 are folded inwardly toward exterior wall panels 418 and 468 as indicated by arrows $B_2$ and $C_2$, respectively, and panels 428, 478 are folded inward toward interior floor panels 420 and 470 as indicated by arrows $D_2$, respectively. It should be appreciated that the phantom lines shown in FIGS. 10-11 indicate the position of the various panels in blank prior to folding. Once completely fully folded inwardly as shown in FIG. 11, left interior edge 411 approaches and preferably abuts with its mating interior edge 429, right interior edge 461 approaches and preferably abuts its mating interior edge 479, and adhesive material applied to the panels (as indicated in FIGS. 8-9) adheres panels 410 and 428 to panel 420, panel 440 to panel 442, and panels 460, 478 to panel 470. In this way the left-most column of panels creates a series of double-walled sides with panels 416 and 418 adhering together to form left sidewall 401, panels 420 and 428 adhering together to form interior floor panel 403. Similarly, panels 466 and 468 adhere together to form right sidewall 405, and panels 470 and 478 adhere together form right interior floor panel 407. Rear wall interior panel 440 folds inward toward and adheres to rear wall exterior wall panel 442 likewise forming a double-layered rear wall 441. Once completely folded as described above, blank 400 assumes its pre-assembly form as a knocked-down carton 500 shown in FIG. 11. As with the prior embodiment, knocked-down carton 500 remains flat, occupies far less surface space than in its un-assembled form shown in FIGS. 8-9, and thus may be stowed to await final assembly.

While the preferred embodiment utilizes adhesive materials to adhere blank panels together, it should be appreciated that any commonly known alternative method of binding panels may be substituted, such as rivets, brads, tacks, staples and the like. Furthermore, conversion of blank 400 into knocked-down carton 500, as discussed above, may be accomplished in any convention manner, for example, in a conventional folder-glue machine as is well-known in the industry.

Figure 12:
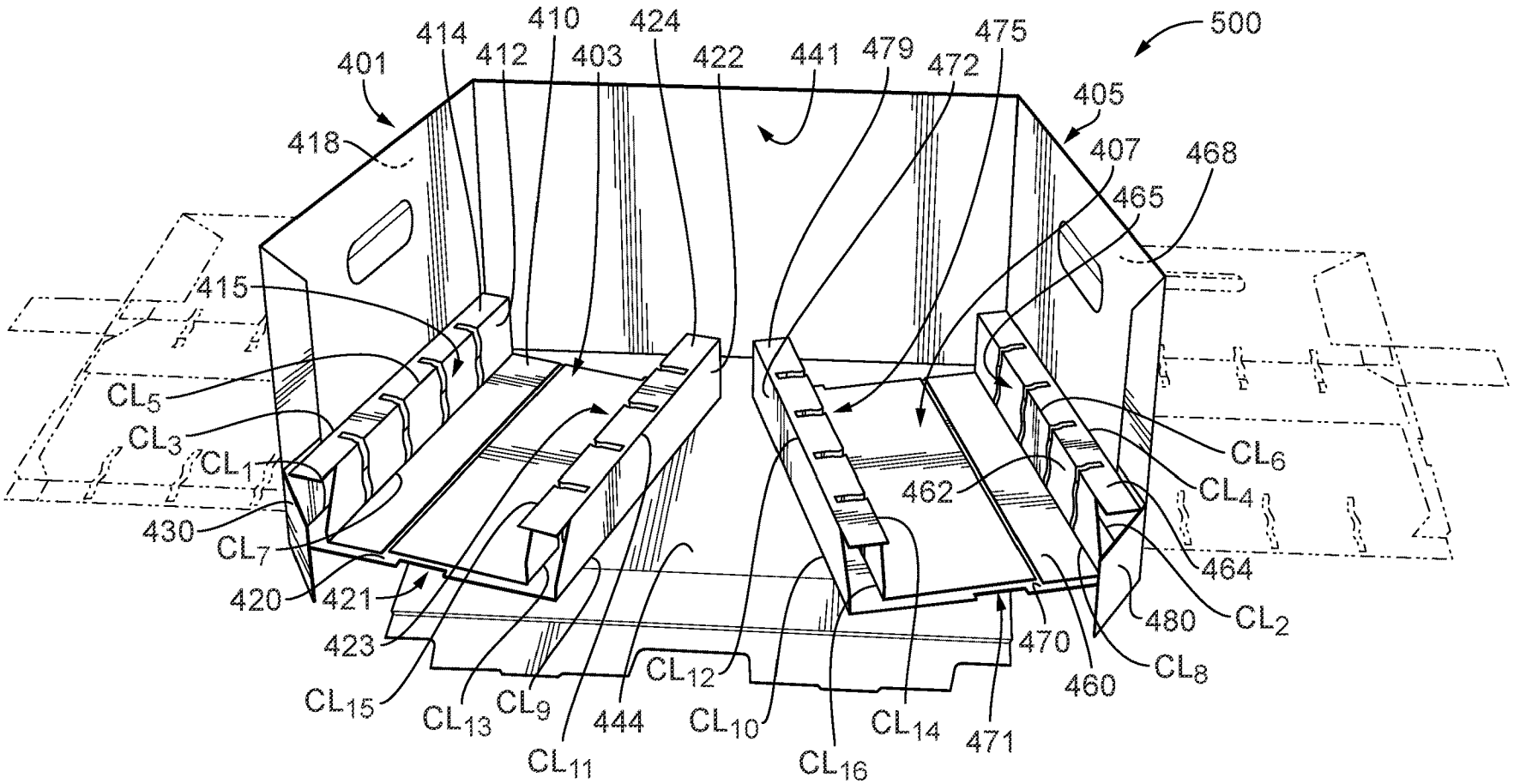
FIG. 12 is a top perspective view of the blank a shown in FIG. 8 in a partially assembled arrangement.
Figure 13:
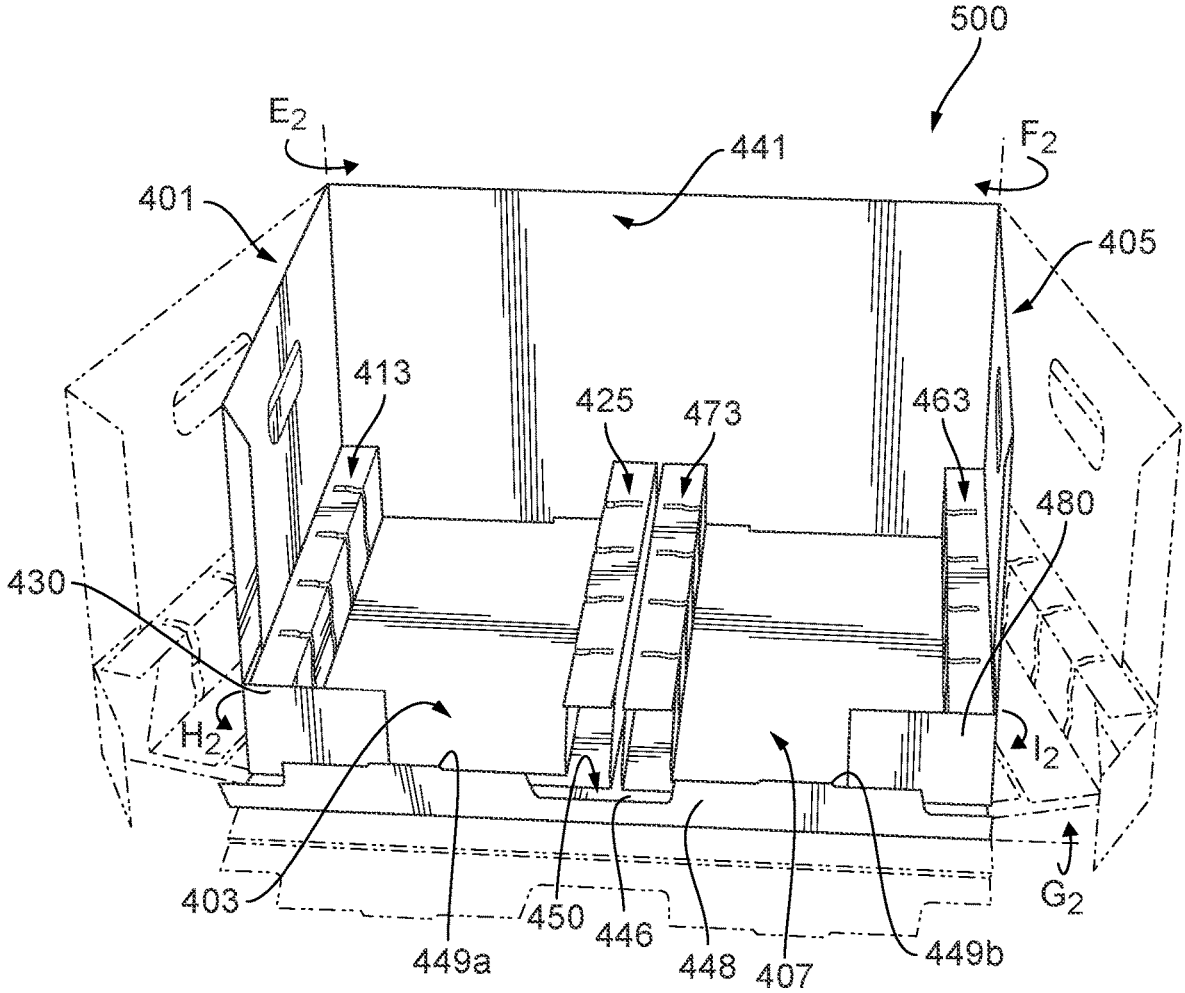
FIG. 13 is a top perspective view of the blank a shown in FIG. 8 in a partially assembled arrangement.

FIGS. 12 and 13 depict the progression through which knocked-down carton 500 is assembled into fully-erected carton 600 (FIG. 14). While new reference numeral 600 is used denote the erected carton, features previously disclosed with respect to carton blank 400 and knocked-down carton 500 in FIGS. 8-11 are designated with the same reference numerals used. Additionally, it should be appreciated that the phantom lines in lines in FIGS. 12-13 indicate the positions of the various panels from which they are folded in order to form the fully-erected carton.

With regard to FIG. 12, panels 401 and 403 are folded up an inward, panels 405 and 407 are folded up an inward, such that walls 401, 405 are generally vertical relative to exterior floor panel 444. As this folding occurs, rear wall panel 441 responds to the movement of sidewall 401, 405 and bends along the fold line between panels 442 (best visible in FIGS. 8 and 9) and 444 into a vertical arrangement. Simultaneously, interior floor panel 403 folds relative to sidewall 401 along the crease line $CL_1$ between panels 418 and 420 and interior floor panel 470 folds along the crease line $CL_2$ between panels 468 and 470 such that interior floor panels 403 and 407 rest atop exterior floor panel 444. Notably, due to the sizing of panels 410, 412, 414, 416 and the arrangement of crease lines $CL_3$, $CL_5$ and $CL_7$, the folding motion of interior floor panel 403 relative to panel 401 forces panels 414 and 416 to fold along $CL_3$, panels 412 and 414 to fold along $CL_5$, and panels 410 and 412 to fold along $CL_7$ thereby forming support rail 415. Similarly, due to the sizing of panels 460, 462, 464, 466 and the offset arrangement of crease lines $CL_4$, $CL_6$, and $CL_8$, the folding motion of interior floor panel 407 relative to panel 405 forces panels 464 and 466 to fold along $CL_4$, panels 462 and 464 to fold along $CL_6$, and panels 460 and 462 to fold along $CL_8$ thereby forming support rail 465. Additionally, the sizing of optional panels 420, 422, 424, 426, 428 and the offset arrangement of $CL_9$, $CL_{11}$, and $CL_{13}$ results in the formation of optional medial support rail 423 when panel 422 folds long $CL_9$ relative to panel 420, as a result of the folding that must occur between adjacent panels along CL9 CL11, CL13 and CL15. Due to the symmetrical design of blank 400 (described above in connection with FIGS. 8 and 9), the sizing of optional panels 470, 472, 474, 476, 478, and the offset arrangement of crease lines CL10, CL12, CL14, and CL16, results in the formation of optional medial support rail 473 when panel 472 folds long $CL_{10}$ relative to panel 470. Beneficially, an assembly technician or warehouse worker can grasp panels 422, 424 in one hand and panels 472, 474 in the other hand and with a quick motion fold the knocked-down carton into the arrangement shown in FIG. 12.

Turning to FIG. 13, left wall 401 and left floor panel 403 have been folded completely inward along arrow $E_2$ and right wall 405 and right floor panel 407 have been folded completely inward along arrow F2 such that panels 422 and 472 abut or very nearly abut each other and edges 427, 477 abut rear wall 441. Panels 430 and 480 are folded inward in the direction of arrows $H_2$, $I_2$, respectively until they abut double-walled panels 403, 407 and cannot be folded further without resulting doing damage to or creating unwanted creases. Panels 446 and 448 are folded in the direction of arrow G2 such that panels 430 and 480 are sandwiched between panels 446 and 448 and retaining tabs 449*a*, 449*b* releasably engage edge recesses 421, 471 (visible in FIG. 12) thereby forming a low front wall 447 for the carton (FIG. 14). Alignment tabs 490, 492 engage with recess 450, thereby aligning and retaining optional rails 423, 473 in their correct arrangement. Accordingly, each support slit 413 of rail 415 is now aligned with and spaced apart from one of support slits 425 of optional rail 423, and each support slit 463 of rail 465 is aligned and spaced apart from a corresponding opposite support slit 473 of optional rail 475. In this manner, the support slits of rails 415 and 465 and optional rails 423, 475 are arranged appropriately to serve as an integrated tray for receiving and displaying a plurality of items or packaging 610 as in a tidy array as indicated in FIG. 14. It should be appreciated that the array may be on or more columns, even though the present disclosure describes and depicts a two-column array. It should be further appreciated that the support slits may be slightly curved or serpentine in shape to apply slight surface pressure to items 610 when inserted into the support slits. In this way, the items are securely held in position during transport without jostling, but still allow for a stocking clerk or consumer to conveniently remove the items from positions within carton 600.

Figure 15:
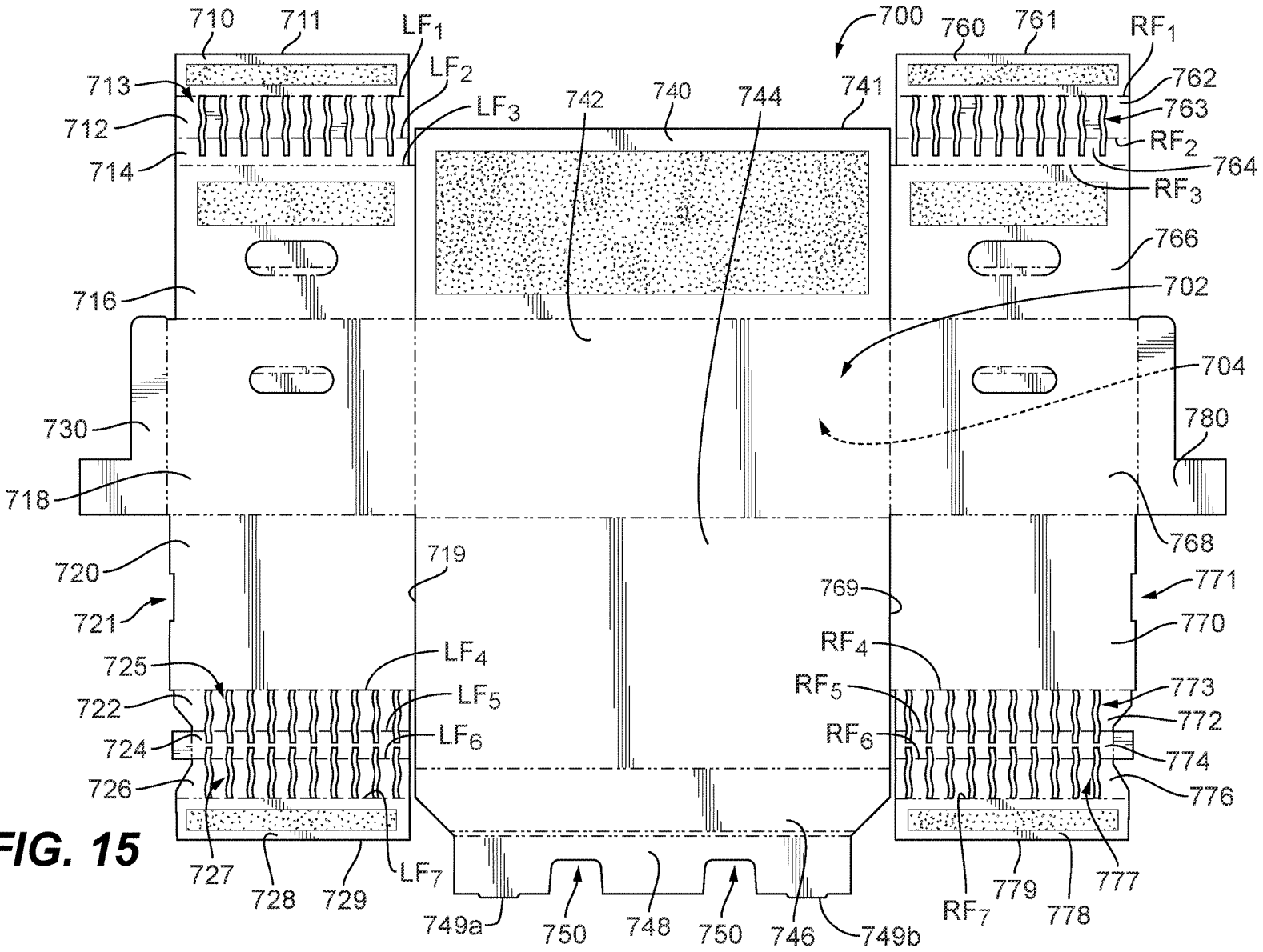
FIG. 15 is a top plan view of a blank of sheet material for forming a second exemplary embodiment of a shipping carton described herein.
Figure 16:
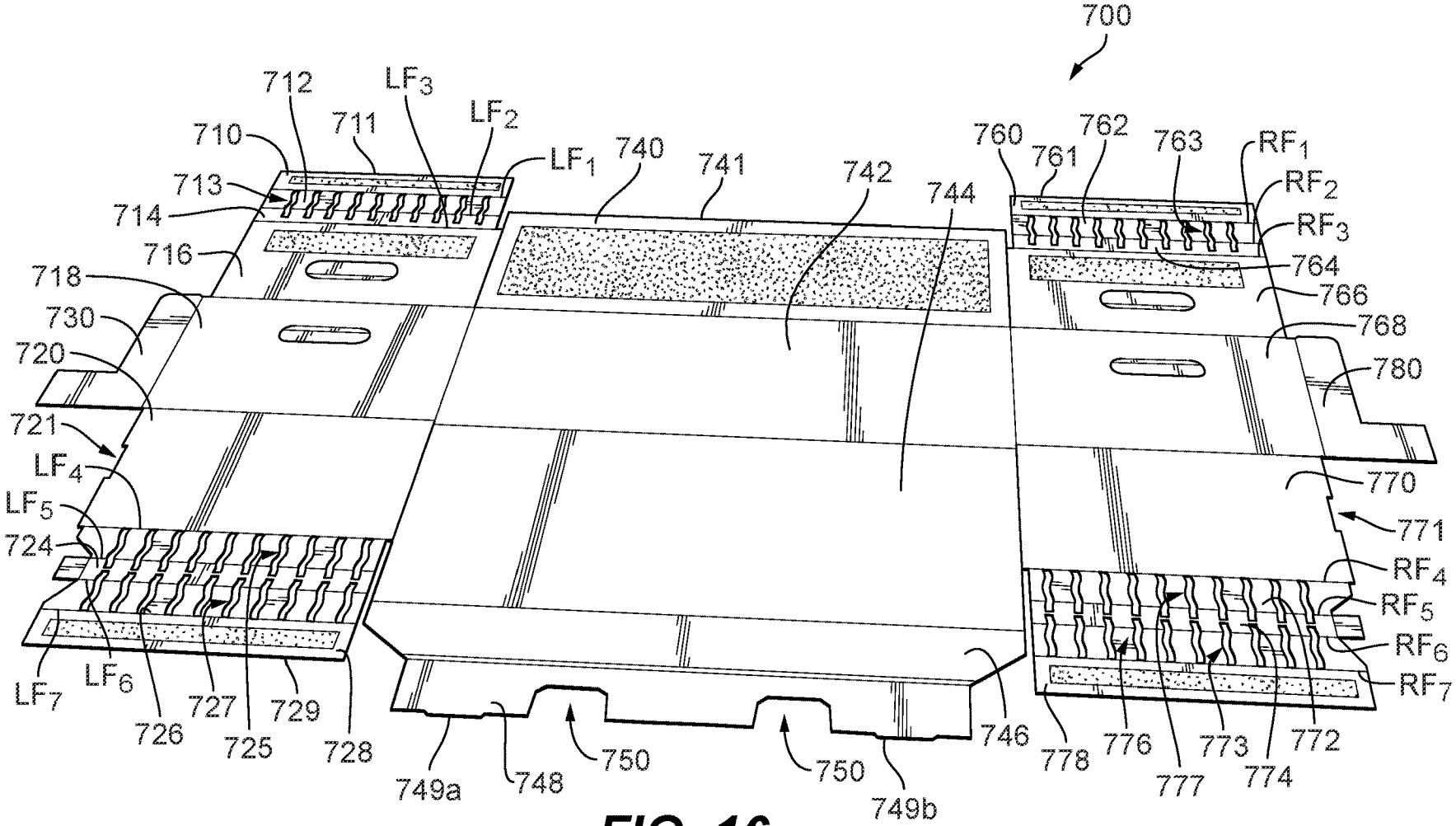
FIG. 16 is a top perspective view of the blank of sheet material shown in FIG. 15.
Figure 21:
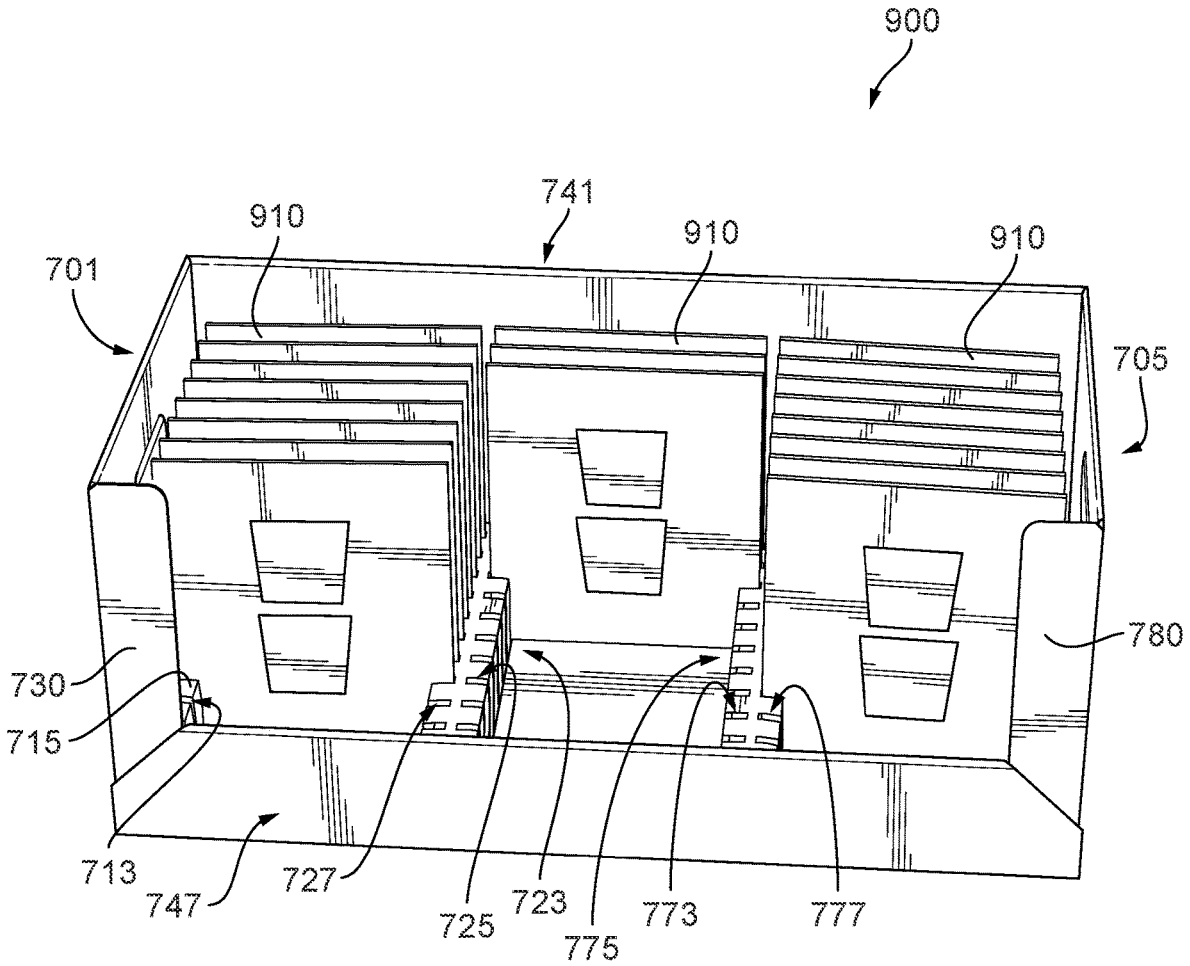
FIG. 21 is a perspective view of a fully assembled shipping carton formed from the blank shown in FIG. 15 partially filled with exemplary products.

FIG. 15 is a top view of a third preferred embodiment an exemplary blank 700 of sheet material for forming a shipping and display carton 900 (FIG. 21) capable of securing packaged items arranged in at least a three-column array as indicated in FIG. 21; FIG. 16 likewise shows blank 700 from a top perspective view. As in the previously described embodiments, blank 700 has an interior surface 702 and an opposing or exterior surface 704. Blank 700 preferably comprises a left-most column of panels: first glue panel 710 that defines an interior edge 711, first divider panel 712, second divider panel 414, left interior wall panel 716, left exterior wall panel 718, left interior floor panel 720 preferably defining a retaining recess 721 and a rear edge 719, third divider panel 722, fourth divider panel 724, fifth divider panel 726, and a second glue panel 728 that defines an interior edge 729. The panels described immediately above are demarcated by a series of pre-formed, generally parallel fold lines, which may include any suitable line of weaking or folding known by those skilled in the art and guided by the teachings provided herein; however, special reference is made to crease lines $LF_1$ (between panels 710, 712), $LF_2$ (between panels 712, 714), $LF_4$ (between panels 720, 722), $LF_5$ (between panels 722, 724), LF6 (between panels 724, 726), and $LF_7$ (between panels 726, 728), which will be discussed in further detail in connection with FIG. 19. An optional a support panel 730 may extend leftward from exterior wall panel 718 being demarcated therefrom by a fold line which may be formed from any suitable line for separating adjacent panels known by those skilled in the art, such as perforations or complete cuts. Glue, hot-melt, or other adhesive materials commonly known to those skilled in the art may be applied to one or more of panels 710, 716, and 728 for adherence to their mating surfaces during carton assembly as described below (adhesive material is represented in the figures by the conventional symbol for adhesives). Panels 712 and 714 define a plurality of support slits exemplified by 713, panels 722 and 724 together define a second plurality of support slits exemplified by 725, and panels 726 and 728 define a third plurality of support slits exemplified by 727.

Blank 700 preferably also comprises a central column of panels: rear interior panel 740 (preferably with adhesive thereto as indicated by the conventional markings), rear exterior panel 742, exterior floor panel 744, front exterior panel 746 and front interior panel 748 that defines a pair of retaining tabs 749*a*, 749*b*, and optional alignment recesses 750. A right most column of panels comprises, in order, panels 760, (which further defines an interior edge 761), 762, 764, 766, 768, 770 (which preferably defines a retaining recess 771 and rear edge 769), 772, 774, 776, 778 (which further defines an interior edge 779) and optional panel 780. As is apparent from FIGS. 15 and 16, the right-most column of panels is symmetrical and largely identical to the panels of the left-most column of panels described above, and, likewise, adhesive materials commonly known to those skilled in the art may be applied to one or more of panels 760, 766, and 778 for adherence to their respective mating surfaces during carton assembly as described below. As with the panels of the left-most column the panels of the central column and right-most column are preferably demarcated by a series of pre-formed fold lines, with particular reference made to $RF_{1-7}$.

Figure 17:
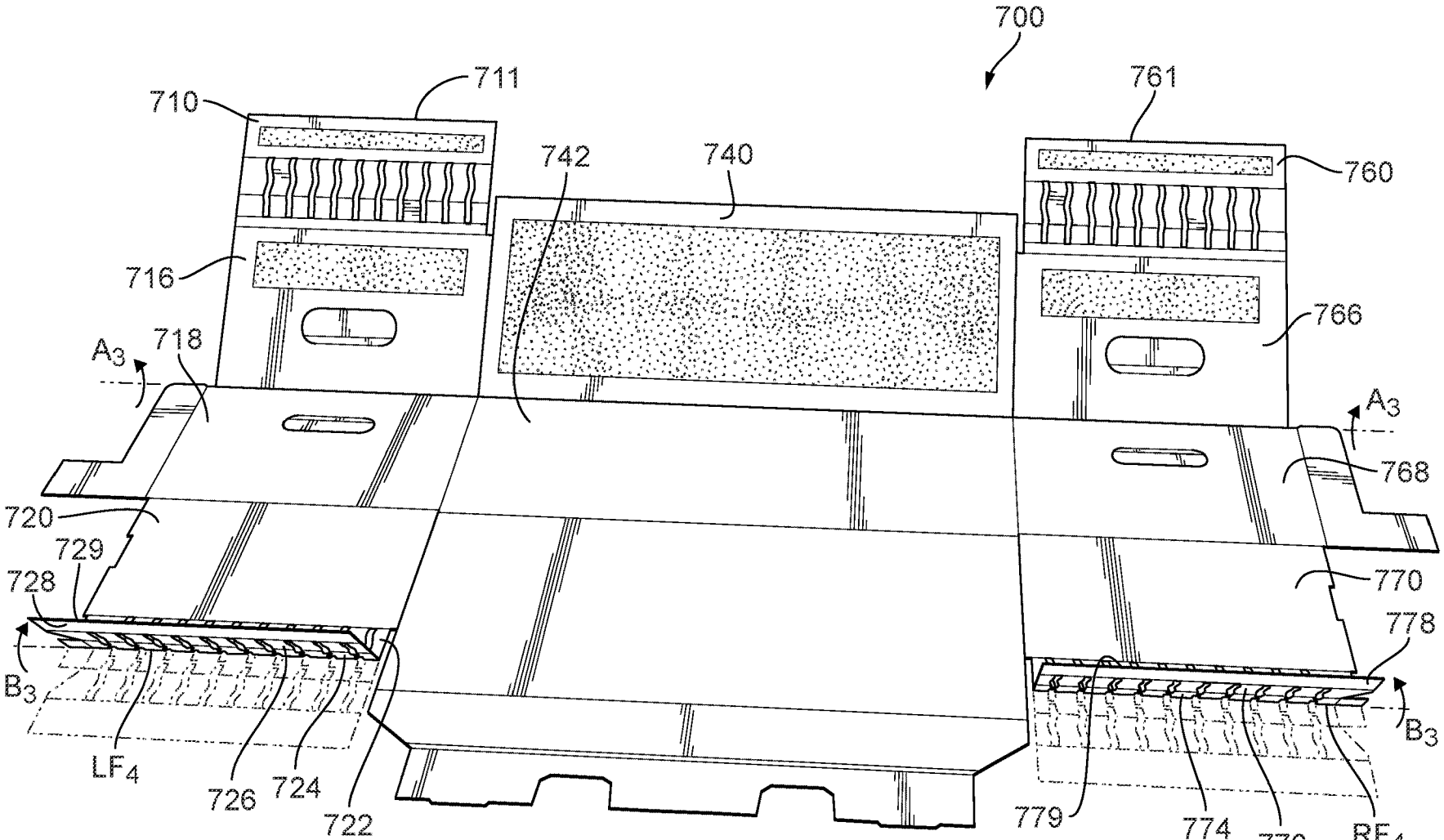
FIG. 17 is a top perspective view of the blank a shown in FIG. 15 in a partially assembled arrangement.
Figure 18:
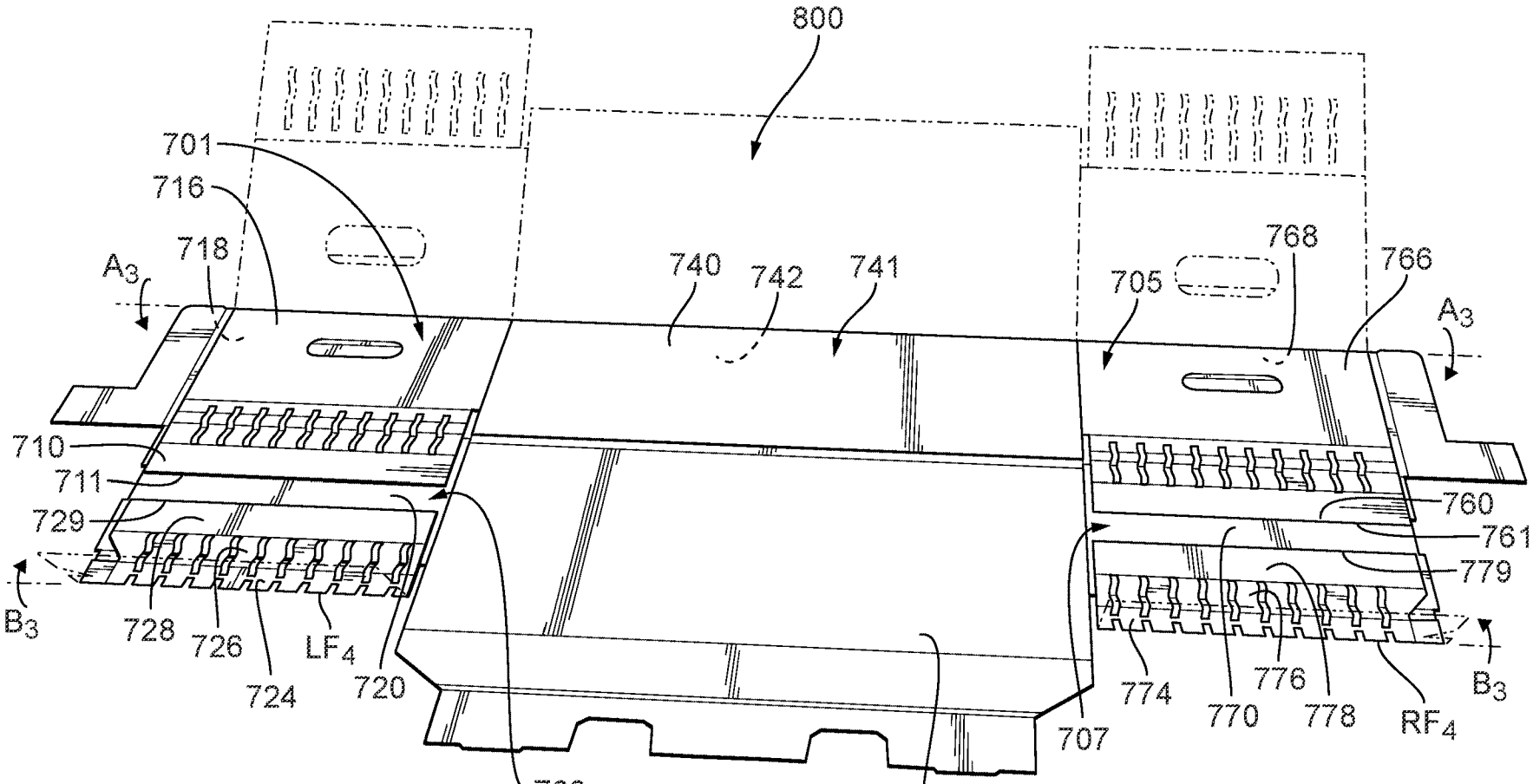
FIG. 18 is a top perspective view of the blank a shown in FIG. 15 in a partially assembled arrangement.

FIGS. 17-18 show how panels of blank 700 may be manipulated in order to form the knocked-down carton 800 (shown in FIG. 18). It is noted that, although the new reference numeral 800 is presented, features previously disclosed with respect to carton blank 700 and knocked-down carton 800 are designated with the same reference numerals previously used in FIGS. 15 and 16. FIG. 17 shows a top perspective view of blank 700 in a pre-assembly arrangement, with panels 716, 740, and 766 slightly folded inward toward panels 718, 742, and 768 respectively as indicated by arrows A3, along their respective fold lines. Panels 724, 774 are folded inward toward interior floor panels 720 and 770 along fold lines $LF_4$, $RF_4$ as indicated by arrows B3, respectively. It should be appreciated that the phantom lines shown in FIGS. 17-18 indicate the position of the various panels prior to folding. Once fully folded inwardly as shown in FIG. 18, left interior edge 711 approaches and optionally abuts with its mating interior edge 729, right interior edge 761 approaches and optionally abuts its mating interior edge 779, and adhesive material applied to the panels (as indicated in FIGS. 15-16) adheres panels 710 and 728 to panel 720, panel 740 to panel 742, and panels 760, 778 to panel 770. In this way the left-most column of panels creates a series of double-walled sides with panels 716 and 718 adhering together to form left sidewall 701, panels 720, 728 adhering to 728 to form interior floor panel 703. Similarly, panels 766 and 768 adhere together to form right sidewall 705, and panels 770, 772 adhering to 778 to form right interior floor panel 707. Rear wall interior panel 740 folds inward toward and adheres to rear wall exterior wall panel 742 likewise forming a double-layered rear wall 741. Once completely folded as described above, blank 700 assumes its pre-assembly form as a knocked-down carton 800 shown in FIG. 18. As with the prior embodiments, knocked-down carton 800 remains flat, occupies far less surface space than in its un-assembled form shown in FIGS. 15-16, and thus may be stowed to await final assembly. Additionally, it should be appreciated that as a result of the manner in which blank 700 (FIGS. 15-17) is folded into knocked-down carton 800, the visible surfaces of all panels shown in the perspective view shown in FIG. 18 as well as underside (not visible) are part of exterior surface 704 referenced earlier in regard to FIG. 15.

Figure 19:
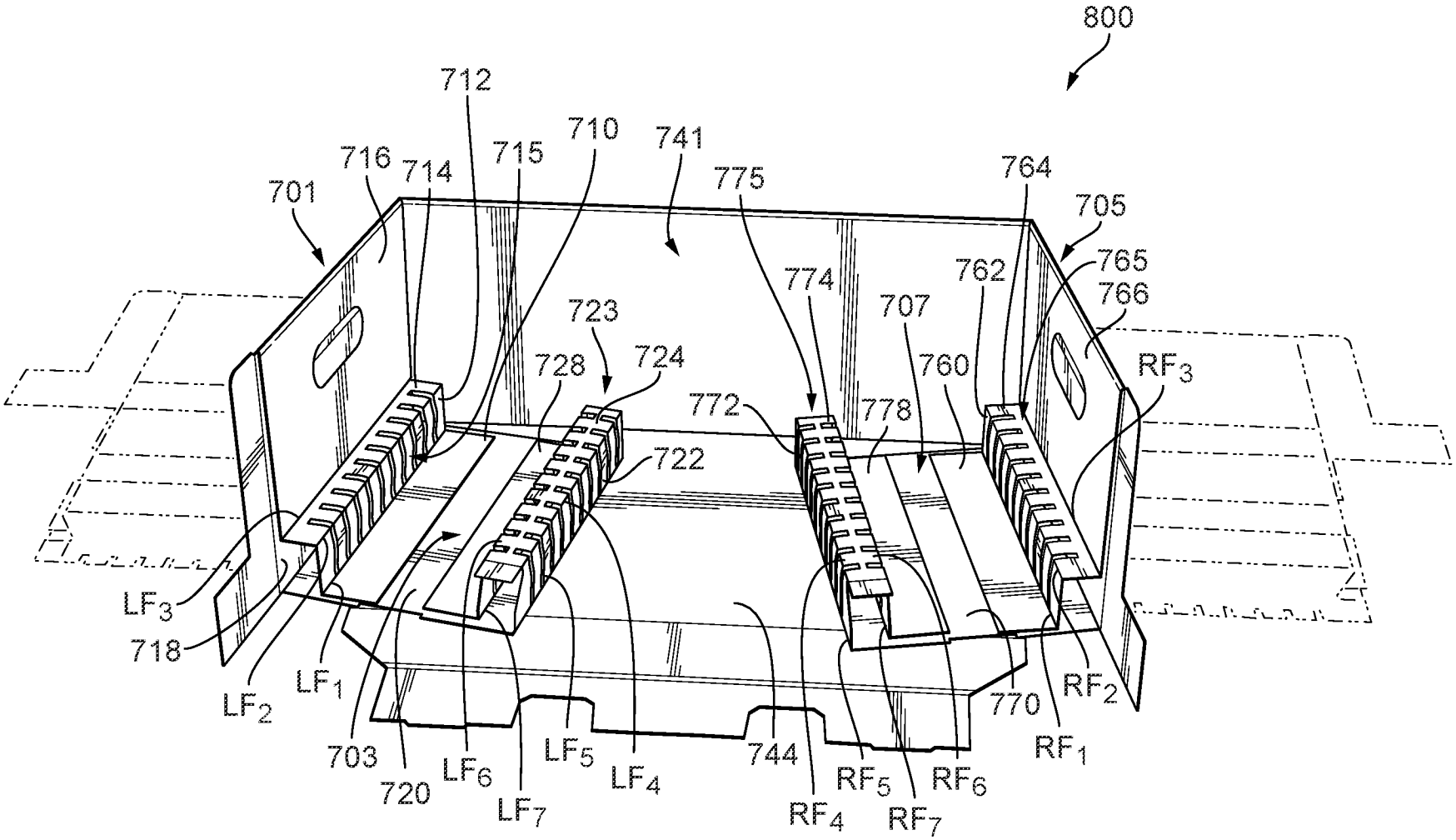
FIG. 19 is a top perspective view of the blank a shown in FIG. 15 in a partially assembled arrangement.
Figure 20:
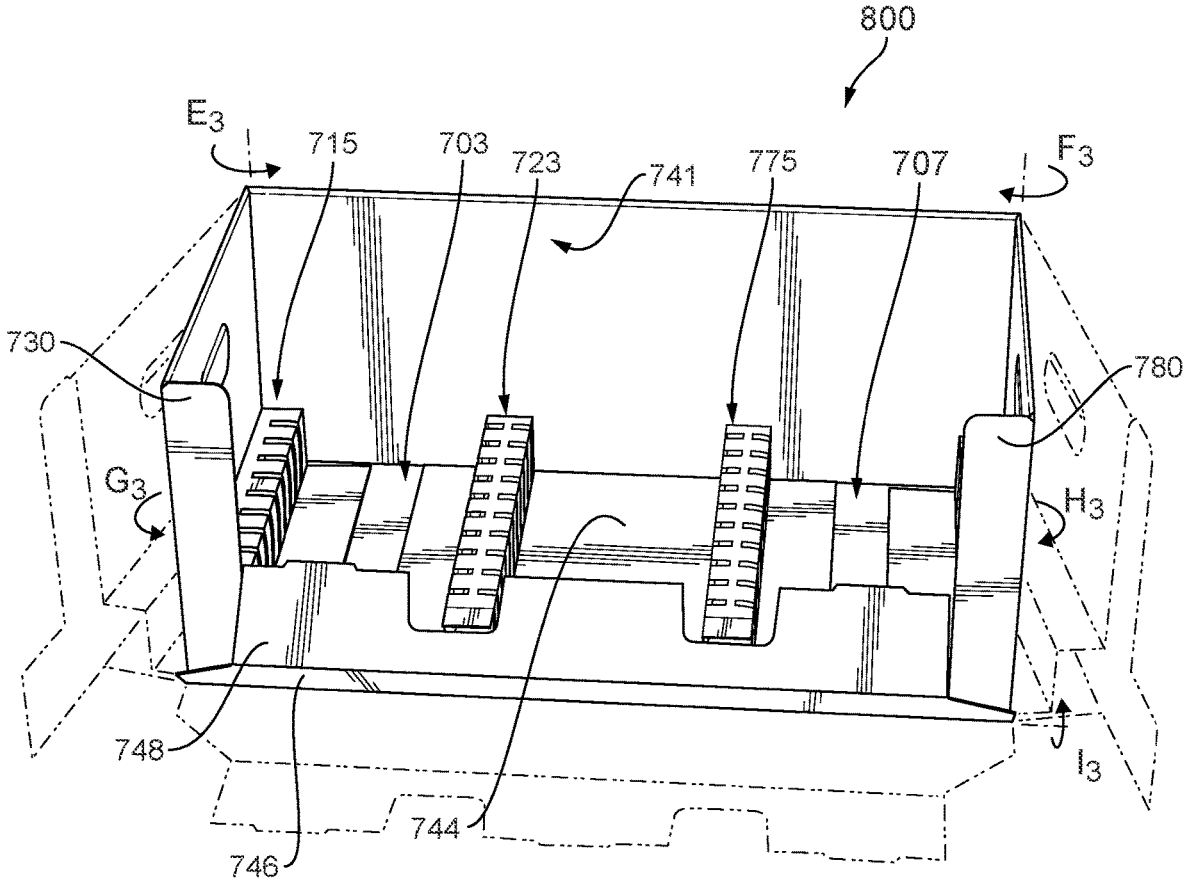
FIG. 20 is a top perspective view of the blank a shown in FIG. 15 in a partially assembled arrangement.

FIGS. 19 and 20 depict the progression through which knocked-down carton 800 is assembled into fully-erected carton 900 (FIG. 13). While new reference numeral 900 is used denote the erected carton, features previously disclosed with respect to carton blank 700 and knocked-down carton 800 in FIGS. 15-18 are designated with the same reference numerals used. Additionally, it should be appreciated that the phantom lines in lines in FIGS. 19-20 indicate the positions of the various panels from which they are folded in order to form the fully-erected carton.

With regard to FIG. 19, panels left sidewall 701 and left interior floor panel 703 are folded up an inward, right sidewall 705 and right interior floor panel 707 are folded up an inward, such that walls 701, 705 are generally vertical relative to exterior floor panel 744. As this folding occurs, rear wall panel 741 responds to the movement of sidewall 701, 705 and bends along the fold line between panels 442 and 444 (best visible in FIGS. 15 and 16) into a vertical arrangement. Simultaneously, interior floor panel 703 folds relative to sidewall 701 along the crease line $LF_4$ and interior floor panel 770 folds along the crease line $RF_4$ such that interior floor panels 703 and 707 rest atop exterior floor panel 744. Notably, due to the sizing of panels 710, 712, 714, 716 and the arrangement of crease lines $LF_1$, $LF_2$ and $LF_3$, the folding motion of interior floor panel 703 relative to panel 701 forces panels 714 and 716 to fold along $LF_3$, panels 712 and 714 to fold along LF2, and panels 710 and 712 to fold along $LF_1$ thereby forming support rail 715. Similarly, due to the sizing of panels 760, 762, 764, 766 and the offset arrangement of crease lines $RF_1$, $RF_2$, and $RF_3$, the folding motion of interior floor panel 707 relative to panel 705 forces panels 764 and 766 to fold along $RF_3$, panels 762 and 764 to fold along $RF_2$, and panels 760 and 762 to fold along $RF_1$ thereby forming support rail 765. Additionally, the sizing of panels 720, 722, 724, 726, 728 and the offset arrangement of $LF_4$, $LF_5$, $LF_6$, and $LF_7$ results in the formation of support rail 723 when panel 722 folds long $LF_4$ relative to panel 720, forcing the panels 722, 724, 726, and 728 to likewise fold along intermediate fold lines $LF_5$, $LF_6$, and $LF_7$ to form support rail 723 as indicated. Due to the symmetrical design of blank 700 (described above in connection with FIGS. 15 and 16), the sizing of panels 770, 772, 774, 776, 778, and the offset arrangement of crease lines $RF_4$, $RF_5$, $RF_6$, and $RF_7$, results in the formation of support rail 775 when panel 772 folds long $RF_4$ relative to panel 770. Beneficially, an assembly technician or warehouse worker can grasp panels 722, 724 in one hand and panels 772, 774 in the other hand and with a quick motion fold the knocked-down carton into the arrangement shown in FIG. 20.

Turning to FIG. 20, left wall 701 and left floor panel 703 have been folded completely inward along arrow $E_3$ and right wall 705 and right floor panel 707 have been folded completely inward along arrow $F_3$ such that panels 703, 707 and support rails 723, 775 abut rear wall panel 741. Panels 430 and 480 are folded inward in the direction of arrows $G_3$, $H_3$, respectively until they come into contact with the floor panels 703, 707 and support rails 773, 775 and cannot be folded further without resulting doing damage to the carton. Panels 746 and 748 are folded in the direction of arrow 13 such that the lower portions of panels 730 and 780 are sandwiched between panels 746 and 748 and retaining tabs 749*a*, 749*b* (visible in FIG. 15) releasably engage edge recesses 721, 771 (also visible in FIG. 15) thereby forming a front wall 747 for the carton (FIG. 21). Additionally, support slits 713 of rail 715 are now aligned with and spaced apart from support slits 727 of rail 723, support slits 763 of rail 765 (not visible in FIG. 21) are aligned and spaced apart from with support slits 777 of rail 775, and, notably, support slits 725 of rail 723 are aligned with and spaced apart from slits 773 of rail 775. In this manner, the support slits of rails 715, 723, 765, and 775 are arranged appropriately to serve as an integrated tray for receiving and displaying a plurality of items or packaging 910 as in a tidy three-column array as indicated in FIG. 21. It should be appreciated that the present embodiment could be modified to provide an integrated tray with four or more columns for items by providing additional folding panels to create support rails as described herein. It should be appreciated that the support slits may be slightly curved or serpentine in shape to apply slight surface pressure to items 910 when inserted into the support slits. In this way, the items are securely held in position during transport without jostling, but still allow for a stocking clerk or consumer to conveniently remove the items from positions within carton 900.

As described herein, the disclosed embodiments of the blank and carton formed offer numerous benefits over the prior art. Namely, each embodiment of the blank can be die-cut from a single sheet of media such as paper board, whether corrugated cardboard, heavy card stock, or laminated paper board. A large sheet of rough cut or bulk media may be loaded into a die-cut machine, the die may be pressed into the media, and all required exterior edges, cutlines and fold lines can be introduced to the media in a single step. Additionally, in each embodiment the blanks need only to have adhesive material applied as shown (or rivets, staples or other means of attachment may be installed) in order to create a knocked-down carton, and manipulation of the knocked-down carton into a fully-erected carton requires only three quick movements from the assembly tech: (1) folding the right and left floor panels and the side and rear walls up and inward to form a general box-shape; (2) folding in the left and right panels support panels and front panels to create the front wall; and (3) inserting the front wall retaining tabs into the retaining recesses of the floor to lock the panels in place. Additionally, while the carton of the current invention may require a larger sheet of rough media, there is far less waste from cutting and pressing than prior designs that require the assembly of multiple separate components, each of which must be cut and, thereby, generate additional waste material. In each embodiment, arrangement of panels on a single, one-piece blank and the folding procedure creates a largely parallel-piped carton that has double-thickness vertical walls, and triple thickness floor for durability and structural integrity during loading and transport without the need for additional separate parts or additional manufacturing steps. Additionally, the blank may be arranged to allow for a flat floor to accommodate large items or may provide one or more support rails to arrange and display products in one or more columns. Finally, the present carton, when fully assembled, has a remarkable advantage in that surfaces visible to the consumer-the exterior and interior of each of the side, rear and front walls, and floor-are each comprised by exterior surface. For example, if the blank is formed from multi-layered media, such as corrugated cardboard or laminated paperboard, the manufacturer may print advertising, branding, instructions, or other graphics, on the layer of the media that will eventually serve as exterior surface prior to milling or die-cutting, thereby creating a carton that is sturdy, visually distinctive, and aesthetically pleasing.

It should be understood that the example embodiments described herein should be considered in a descriptive sense only and not for purposes of limitation. Descriptions of features or aspects within each embodiment should typically be considered as available for other similar features or aspects in other embodiments.

We claim:

1. A foldable blank for forming a carton for shipping and displaying a plurality of products, the blank comprising:

a plurality of foldably connected panels, further comprising:

a one-piece exterior rear panel, a one-piece interior rear panel, a first exterior side panel, a one-piece exterior floor panel, a second exterior side panel, and an exterior front panel;

wherein said exterior front panel is foldably connected to an interior front panel to form a double-layered front wall;

wherein said first exterior side panel is foldably connected to a first interior side panel, said first interior side panel is foldably connected to a first support rail, said first support rail is foldably connected to a first interior floor panel, and a first medial support rail is foldably connected to said first interior floor panel; and wherein said second exterior side panel is foldably connected to a second interior side panel, said second interior side panel is foldably connected to a second support rail, said second support rail is foldably connected to a second interior floor panel, and a second medial support rail is foldably connected to said second interior floor panel;

wherein said first and second interior floor panels are appropriately positioned relative to said one-piece exterior floor panel to form a generally double-layered floor;

wherein said one-piece exterior rear panel and said one-piece interior rear panel together form a double-layered rear wall, said first exterior side panel and said first interior side panel together form a double-layered first sidewall, and said second exterior side panel and said second interior side panel together form a double-layered second sidewall, wherein said double-layered rear wall, double-layered floor, double-layered front wall, and first and second sidewalls cooperate to define a generally rectangular prismatic recess adapted to receive a plurality of products;

wherein said first support rail, first medial support rail, second support rail, and second medial support rail each define a plurality of support slots adapted to receive at least a portion of one of the products to secure and display the product within said prismatic recess.

2. The blank of claim 1 wherein each of said plurality of first support rail support slots is arranged and adapted to cooperate with a corresponding one of said plurality of first medial support rail support slots to receive at least a portion of one of the products, and wherein each of said second rail support slots is arranged and adapted to cooperate with a corresponding one of said plurality of second medial support rail support slots to receive at least a portion of one of the products, thereby securing and displaying the products within said prismatic recess.

3. The blank of claim 1 wherein said interior front panel further defines a first retaining tab and a second retaining tab;

said first interior floor panel further defines a first retaining recess;

said second interior floor panel further defines a second retaining recess;

wherein, said first and second retaining recess are adapted to releasably retain a respective one of said first and second retaining tabs.

* * * * *